US006442986B1

(12) United States Patent
Russell et al.

(10) Patent No.: US 6,442,986 B1
(45) Date of Patent: Sep. 3, 2002

(54) ELECTRONIC TOKEN AND LOCK CORE

(75) Inventors: Roger Keith Russell; James Edmond Beylotte; Ralph P. Palmer, all of Indianapolis, IN (US)

(73) Assignee: Best Lock Corporation, Indianapolis, IN (US)

( * ) Notice: Subject to any disclaimer, the term of this patent is extended or adjusted under 35 U.S.C. 154(b) by 0 days.

(21) Appl. No.: 09/287,981

(22) Filed: Apr. 7, 1999

Related U.S. Application Data

(60) Provisional application No. 60/080,974, filed on Apr. 7, 1998.

(51) Int. Cl.[7] ..... E05B 47/06

(52) U.S. Cl. ..... 70/278.3; 70/278.7; 70/283.1; 70/359; 70/371

(58) Field of Search ..... 70/278.2, 278.3, 70/278.6, 278.7, 279.1, 283, 283.1, 367–369, 371, 359

(56) References Cited

U.S. PATENT DOCUMENTS

| | | | | |
|---|---|---|---|---|
| 2,105,304 A | 1/1938 | Wagner | | 200/44 |
| 3,136,307 A | 6/1964 | Richard | | |
| 3,160,792 A | 12/1964 | Brendemuehl et al. | | |
| 3,283,550 A | 11/1966 | Bradway | | |

(List continued on next page.)

FOREIGN PATENT DOCUMENTS

| | | | |
|---|---|---|---|
| DE | 2739062 | 3/1978 | |
| DE | 2828336 | 1/1980 | |
| DE | 3008728 | * 9/1981 | 70/279.1 |
| EP | 0 065 182 A2 | 11/1982 | |
| EP | 0 168 884 | 1/1986 | |
| EP | 0 248 488 A2 | 12/1987 | |
| EP | 0 248 488 B1 | 12/1987 | |
| EP | 0 276 037 A2 | 7/1988 | |
| EP | 0 276 037 B1 | 7/1988 | |
| EP | 0 494 472 A1 | 7/1992 | |
| FR | 1380749 | 10/1964 | |
| FR | 2 363 837 | 3/1978 | |
| GB | 1 401 281 | 7/1975 | |
| WO | WO 87/00234 | 1/1987 | |
| WO | WO 92/07156 | 4/1992 | |
| WO | WO 92/07342 | 4/1992 | |

OTHER PUBLICATIONS

The National Locksmith, "Falcon's Gibraltar System 2000", by Paul Hoos, dated Mar. 27, 1986, pp. 20–23.

Brochure entitled "Solitaire Plus Applications/Specifications" published by Marlock Company.

Brochure entitled "Lori Lock—Security Door Hardware", 08710/LS, BuyLine 2056, pp. 2056, pp. 1–8, published by Lori Corporation.

*Primary Examiner*—Lloyd A. Gall
(74) *Attorney, Agent, or Firm*—Barnes & Thornburg

(57) ABSTRACT

A lock core for use with a token having an access code and a blade is provided. The lock core includes a core body, a lock actuator coupled to the core body for movement, a token communicator configured to read the access code when the blade is inserted into a passageway of the lock actuator, at least one movable tumbler element, a movable blocker, a biasing member situated between the at least one tumbler element and the blocker, and an electromagnetic actuator coupled to the core body and coupled to the token communicator. Insertion of the token in the passageway moves the at least one tumbler element to store energy in the biasing member. If the token communicator reads the access code after insertion of the token in the passageway, the electromagnetic actuator moves to unlock the blocker and the biasing member releases energy to move the blocker.

52 Claims, 14 Drawing Sheets

U.S. PATENT DOCUMENTS

| | | | | | |
|---|---|---|---|---|---|
| 3,296,842 | A | * | 1/1967 | Averbach et al. | 70/371 |
| 3,347,072 | A | | 10/1967 | Rose | |
| 3,392,559 | A | | 7/1968 | Hedin et al. | |
| 3,579,183 | A | | 5/1971 | Lipschutz | 70/395 X |
| 3,599,454 | A | | 8/1971 | Hill et al. | 70/265 |
| 3,639,906 | A | | 2/1972 | Tritsch | 70/277 X |
| 3,660,624 | A | | 5/1972 | Bell | 70/239 X |
| 3,660,831 | A | | 5/1972 | Nicola et al. | 70/277 X |
| 3,798,398 | A | | 3/1974 | Hills | 70/429 X |
| 3,889,501 | A | | 6/1975 | Fort | 70/283 |
| 3,958,105 | A | | 5/1976 | Sidlauskas | 235/61.11 H |
| 3,970,824 | A | | 7/1976 | Walton et al. | 235/61.11 H |
| 4,137,985 | A | | 2/1979 | Winchell | 70/237 X |
| 4,142,389 | A | * | 3/1979 | Bahry et al. | 70/359 |
| 4,142,674 | A | | 3/1979 | Walton | 70/277 X |
| 4,148,372 | A | | 4/1979 | Schroeder | 70/DIG. 46 X |
| 4,176,782 | A | | 12/1979 | Fukuda et al. | 70/271 X |
| 4,192,400 | A | | 3/1980 | McEwan | 180/287 |
| 4,200,227 | A | | 4/1980 | Lemelson | 235/382 |
| 4,205,325 | A | | 5/1980 | Haygood et al. | 361/172 X |
| 4,250,533 | A | | 2/1981 | Nelson | 361/172 |
| 4,257,030 | A | | 3/1981 | Bruhin et al. | 70/413 X |
| 4,267,494 | A | | 5/1981 | Matsuoka et al. | 318/568 |
| 4,291,237 | A | | 9/1981 | Kitano | 180/287 X |
| 4,292,541 | A | | 9/1981 | Ambrosius | 180/287 X |
| 4,297,569 | A | | 10/1981 | Flies | 70/283 X |
| 4,298,792 | A | | 11/1981 | Granholm et al. | 235/375 |
| 4,326,125 | A | | 4/1982 | Flies | 70/283 X |
| 4,327,353 | A | | 4/1982 | Beard et al. | 180/287 X |
| 4,366,466 | A | | 12/1982 | Lutz | 180/287 X |
| 4,415,893 | A | | 11/1983 | Roland et al. | 235/382 X |
| 4,420,794 | A | | 12/1983 | Anderson | 70/DIG. 46 X |
| 4,435,649 | A | | 3/1984 | Vandergriff | 180/287 X |
| 4,436,993 | A | | 3/1984 | Flies | 235/382 |
| 4,438,426 | A | | 3/1984 | Adkins | 180/287 X |
| 4,458,512 | A | | 7/1984 | Gelhard | 70/277 |
| 4,507,944 | A | | 4/1985 | Widen et al. | 70/276 |
| 4,511,946 | A | | 4/1985 | McGahan | 361/172 |
| 4,526,256 | A | | 7/1985 | Urdal | 192/40 |
| 4,562,712 | A | | 1/1986 | Wolter | 70/456 R |
| 4,603,564 | A | | 8/1986 | Kleinhany et al. | 70/277 |
| 4,635,455 | A | | 1/1987 | Oliver | 70/378 X |
| 4,663,952 | A | | 5/1987 | Gelhard | 70/408 X |
| 4,686,358 | A | | 8/1987 | Seckinger et al. | 235/382 |
| 4,697,171 | A | | 9/1987 | Suh | 180/272 X |
| 4,703,293 | A | | 10/1987 | Ono et al. | 335/80 |
| 4,704,884 | A | | 11/1987 | Sugimoto | 70/337 |
| 4,712,398 | A | | 12/1987 | Clarkson et al. | 70/276 |
| 4,726,205 | A | | 2/1988 | Allerdist et al. | 70/395 |
| 4,734,693 | A | | 3/1988 | Dluhosch et al. | 70/271 X |
| 4,749,072 | A | | 6/1988 | Lichty et al. | 192/40 |
| 4,771,620 | A | | 9/1988 | Kleinhäny | 70/277 |
| 4,789,859 | A | * | 12/1988 | Clarkson et al. | 70/278.3 X |
| 4,791,280 | A | | 12/1988 | O'Connell et al. | 235/382.5 |
| 4,807,454 | A | | 2/1989 | Sengupta et al. | 70/277 |
| 4,835,407 | A | | 5/1989 | Kataoka et al. | 180/287 X |
| 4,837,822 | A | | 6/1989 | Crosley et al. | 380/23 |
| 4,848,115 | A | | 7/1989 | Clarkson et al. | 70/276 |
| 4,849,749 | A | | 7/1989 | Fukamachi et al. | 70/413 X |
| 4,858,453 | A | | 8/1989 | Namazue | 70/252 X |
| 4,864,292 | A | | 9/1989 | Nieuwkoop | 361/172 X |
| 4,866,962 | A | | 9/1989 | Aston et al. | 70/277 |
| 4,866,964 | A | | 9/1989 | Hall | 70/369 |
| 4,868,409 | A | | 9/1989 | Tanaka et al. | 307/10.5 |
| 4,870,401 | A | | 9/1989 | Lee et al. | 361/172 X |
| 4,916,927 | A | | 4/1990 | O'Connell et al. | 70/276 |
| 4,922,736 | A | | 5/1990 | Tanaka et al. | 70/277 |
| 4,924,686 | A | | 5/1990 | Vonlanthen | 70/277 |
| 4,939,915 | A | | 7/1990 | Vonlanthen | 70/277 |
| 4,943,804 | A | | 7/1990 | Lee et al. | 361/172 X |
| 4,945,269 | A | | 7/1990 | Kamm | 310/15 |
| 4,947,662 | A | | 8/1990 | Imedio | 70/395 |
| 4,972,694 | A | | 11/1990 | Aulbers et al. | 70/277 |
| 4,982,587 | A | | 1/1991 | Tzou | 70/492 |
| 4,998,952 | A | | 3/1991 | Hyatt, Jr. et al. | 70/395 |
| 5,003,801 | A | | 4/1991 | Stinar et al. | 70/408 X |
| 5,005,393 | A | | 4/1991 | Ewalds et al. | 70/277 |
| 5,010,331 | A | | 4/1991 | Dias et al. | 340/825.31 |
| 5,010,750 | A | * | 4/1991 | Böser et al. | 70/278.3 X |
| 5,010,754 | A | | 4/1991 | DeAngelo et al. | 70/389 |
| 5,019,812 | A | | 5/1991 | Gostahagberg et al. | 361/172 X |
| 5,076,081 | A | | 12/1991 | Boris, Jr. | 70/398 |
| 5,079,435 | A | | 1/1992 | Tanaka | 307/10.2 |
| 5,086,288 | A | | 2/1992 | Stramer | 361/172 X |
| 5,086,557 | A | | 2/1992 | Hyatt, Jr. | 29/832 |
| 5,087,090 | A | | 2/1992 | Humphrey et al. | 292/359 |
| 5,088,306 | A | | 2/1992 | Field | 70/375 |
| 5,117,097 | A | | 5/1992 | Kimura et al. | 235/439 |
| 5,131,038 | A | | 7/1992 | Puhl et al. | 235/382 X |
| 5,132,661 | A | | 7/1992 | Pinnow | 70/277 X |
| 5,140,317 | A | | 8/1992 | Hyatt, Jr. et al. | 235/382 X |
| 5,186,031 | A | | 2/1993 | Janssen et al. | 70/277 |
| D333,972 | S | | 3/1993 | Hyatt, Jr. et al. | D8/353 |
| 5,195,341 | A | | 3/1993 | Nieuwkoop | 70/413 X |
| 5,228,730 | A | | 7/1993 | Gokcebay et al. | 292/144 |
| 5,229,648 | A | | 7/1993 | Sues et al. | 307/10.2 |
| 5,245,329 | A | | 9/1993 | Gokcebay | 70/409 X |
| 5,254,842 | A | | 10/1993 | Posner et al. | 235/382 |
| 5,289,177 | A | | 2/1994 | Wake | 307/10.2 X |
| 5,309,743 | A | | 5/1994 | Kokobu et al. | 70/257 |
| 5,311,757 | A | | 5/1994 | Spahn | 70/408 |
| 5,337,043 | A | | 8/1994 | Gokcebay | 235/382.5 X |
| 5,337,588 | A | | 8/1994 | Chhatwal | 70/283 X |
| 5,351,042 | A | * | 9/1994 | Aston | 70/278.3 X |
| 5,367,295 | A | | 11/1994 | Gokecebay et al. | 235/382 X |
| 5,373,718 | A | | 12/1994 | Schwerdt et al. | 70/247 X |
| 5,423,198 | A | * | 6/1995 | DiVito et al. | 70/278.3 |
| 5,433,096 | A | | 7/1995 | Janssen et al. | 70/395 X |
| 5,441,022 | A | | 8/1995 | Yoder et al. | 307/10.5 X |
| 5,442,243 | A | | 8/1995 | Bailey | 307/10.5 |
| 5,469,727 | A | | 11/1995 | Spahn et al. | 70/277 X |
| 5,475,996 | A | * | 12/1995 | Chen | 70/277 X |
| 5,479,799 | A | | 1/1996 | Kilman et al. | 70/231 |
| 5,507,162 | A | | 4/1996 | Chhatwal | 70/283 X |
| 5,526,662 | A | | 6/1996 | Diekhoff et al. | 70/277 X |
| 5,532,522 | A | | 7/1996 | Dietz et al. | 307/10.5 |
| 5,540,069 | A | | 7/1996 | Muller et al. | 70/283 X |
| 5,542,274 | A | | 8/1996 | Thordmark et al. | 70/495 |
| 5,552,777 | A | | 9/1996 | Gokcebay et al. | 361/172 X |
| 5,561,420 | A | | 10/1996 | Kleefeldt et al. | 70/256 X |
| 5,561,430 | A | | 10/1996 | Knebelkamp | 342/44 |
| 5,561,997 | A | | 10/1996 | Milman | 70/283 |
| 5,605,067 | A | | 2/1997 | Juan | 70/413 |
| 5,628,217 | A | | 5/1997 | Herrera | 70/337 X |
| 5,632,168 | A | | 5/1997 | Yano | 70/408 X |
| 5,636,540 | A | * | 6/1997 | Myers | 70/371 X |
| 5,640,863 | A | * | 6/1997 | Frolov | 70/277 X |
| 5,671,621 | A | | 9/1997 | Watanuki et al. | 235/493 X |
| 5,685,182 | A | | 11/1997 | Chhatwal | 70/224 |
| 5,699,686 | A | * | 12/1997 | Neumayer et al. | 70/283 |
| 5,724,028 | A | | 3/1998 | Prokup | 342/42 X |
| 5,749,253 | A | | 5/1998 | Glick et al. | 70/263 |
| 5,768,925 | A | | 6/1998 | Ozawa et al. | 70/408 |
| 5,771,722 | A | | 6/1998 | DiVito et al. | 70/283 X |
| 5,775,148 | A | | 7/1998 | Layton et al. | 70/408 |
| 5,794,178 | A | | 8/1998 | Chamberlain et al. | 70/277 X |
| 5,816,085 | A | * | 10/1998 | Winardi et al. | 70/283 |
| 5,819,564 | A | | 10/1998 | Watanuki | 70/408 X |
| 5,823,027 | A | | 10/1998 | Glick et al. | 70/263 X |
| 5,823,028 | A | | 10/1998 | Mizuno et al. | 70/277 X |
| 5,826,449 | A | | 10/1998 | Dupuis et al. | 70/277 |

5,826,450 A 10/1998 Lerchner et al. ..... 70/277 X
5,836,187 A 11/1998 Janssen et al. ..... 70/252
5,841,363 A 11/1998 Jakob et al. ..... 180/287 X
5,870,913 A 2/1999 Kohzu ..... 70/413 X
5,870,915 A * 2/1999 D'Hont ..... 70/278.3
6,035,675 A * 3/2000 Zimmer et al. ..... 70/283 X

* cited by examiner

ELECTRONIC TOKEN AND LOCK CORE

This application claims the benefit of U.S. provisional application Serial No. 60/080974 filed on Apr. 7, 1998.

BACKGROUND AND SUMMARY OF THE INVENTION

The present invention relates to electronic tokens and lock cores that cooperate to determine if access should be granted to the user of the token. More particularly, the present invention relates to electronic lock cores that are interchangeable.

Conventional locksets include a lock cylinder, a lock core that fits within the lock cylinder, and a token that cooperates with the lock core. The lock cylinder can take many forms. For example, the lock cylinder may be a padlock or part of a mortise lockset or cylindrical lockset. No matter what form the lock cylinder takes, the lock cylinder includes an opening that receives the lock core. Traditionally, the lock cores have included mechanical features that cooperated with a mechanical token to determine if the user of the token is granted or denied access through the lockset. See, for example, U.S. Pat. Nos. 4,424,693, 4,444,034, and 4,386,510.

Electronic access control systems interrogate a token having stored codes therein and compare the token codes with valid access codes before providing access to an area. See, for example, U.S. Pat. No. 5,351,042. If the token being interrogated has a valid access code, the electronic access control system interacts with portions of a lockset to permit the user of the token to gain access to the area protected by the lockset.

Access control systems may include mechanical and electrical access components to require that a token include both a valid "mechanical code", for example, an appropriately configured bitted blade to properly position mechanical tumblers, and the valid electronic access code before the user of the token is granted access. See, for example, U.S. Pat. Nos. 5,826,450, 5,768,925, and 5,685,182. Many of these electromechanical access control systems use power sources and access code validation systems which are not situated in the lock core and token and are thus connected by separate circuitry to the lock core.

An interchangeable lock core that is configured to communicate with a token having an access code and a bitted blade in accordance with the present invention includes a core body, a lock actuator that is coupled to the core body for movement relative to the core body, a token communicator coupled to the core body, and a blocker movable between a first position wherein the lock actuator is fixed to the core body and a second position wherein the lock actuator is movable relative to the core body and means for moving the blocker between the first and second positions, the moving means being coupled to the token communicator and positioned in the core body. The moving means may include an electromagnet, a blocking member that is permitted movement by the electromagnet between the first and second positions, and means for storing energy acquired from the token interacting with the lock core and later using that energy to maintain the blocking member in the second position until the token is removed from the lock core. In alternative embodiments the storing means may be a spring or a permanent magnet.

An alternative embodiment of lock core includes a core body, a lock actuator coupled to the core body for movement relative to the core body, a token communicator coupled to the core body, and an electrical portion coupled to the core body. The electrical portion including a blocker movable between a first position wherein the blocker fixes the position of the lock actuator relative to the core body and a second position wherein the blocker permits movement of the lock actuator relative to the core body, the blocker being pivotable relative to the core body about the center of mass of the blocker. A power supply in one of the token and the core body provides power to the token communicator and an electromagnet controled by the token communicator, wherein the power supply provides current to the electromagnet under the control of the token communicator so as to provide a short pulse of current to the electromagnet. The blocker is sustained in the second position by a biasing mechanism separate from the electromagnet.

Alternative embodiments of the lock core include a passageway formed in the lock actuator, a tumbler barrel partially formed in the core body and partially formed in the lock actuator, the tumbler barrel being in communication with the passageway, and a plurality of tumbler pins contained in the tumbler barrel, the bitted blade engages a tumbler pin when inserted in the passage way and positions the plurality of tumbler pins in the tumbler barrel to allow movement of the lock actuator with respect to the core body.

Additional alternative embodiments of lock core include a first spring capable of biasing the blocking member toward the first position and a second spring capable of biasing the blocking member toward the second position, when the blade of the token is received in the passageway the second spring stores internal energy generated by insertion of the blade to bias the blocking member toward the second position regardless of the access code contained in the token. When the blade is received in the passageway, the electromagnet is energized if the token contains an authorized access code and the latch is decoupled from the blocking body which is urged to the second position by the energy stored in the second spring. The movement of the blocking body to the second position stores internal energy in the first spring. A third spring biases the latch toward engagement with the blocking member.

A method of a token interacting with a lock core includes the steps of providing a token having a token access code and a lock core, the lock core including a token communicator, a core body, a lock actuator coupled to the core body for movement relative to the core body, a blocker movable between a first position preventing movement of the lock actuator relative to the core body and a second position permitting movement of the lock actuator relative to the core body, an electromagnet, an arm coupled to the electromagnet for movement by the electromagnet between a first position in contact with the blocker and a second position spaced apart from the first position, a first biasing member configured to bias the blocker toward its second position, a second biasing member configured to bias the blocker toward its second position, and a token contact coupled to at least one of the springs, placing the token in a position to contact the token contact of the lock core and provide energy to the first biasing member, placing the token in a position to communicate with the token communicator of the lock core so that the token communicator can determine if the token access code of the token is valid, energizing the electromagnet if the token is valid to move the arm from its first position to its second position and permit the first biasing member to move the blocker from its first position to its second position, deenergizing the electromagnet to move the arm to its first position, and moving the token away from the token contact of the lock core to permit the second biasing member to move the blocker to its second position.

Additional features and advantages of the present invention will become apparent to those skilled in the art upon consideration of the following detailed description of preferred embodiments exemplifying the best mode of carrying out the invention as presently perceived.

DETAILED DESCRIPTION OF THE DRAWINGS

Figure 1:
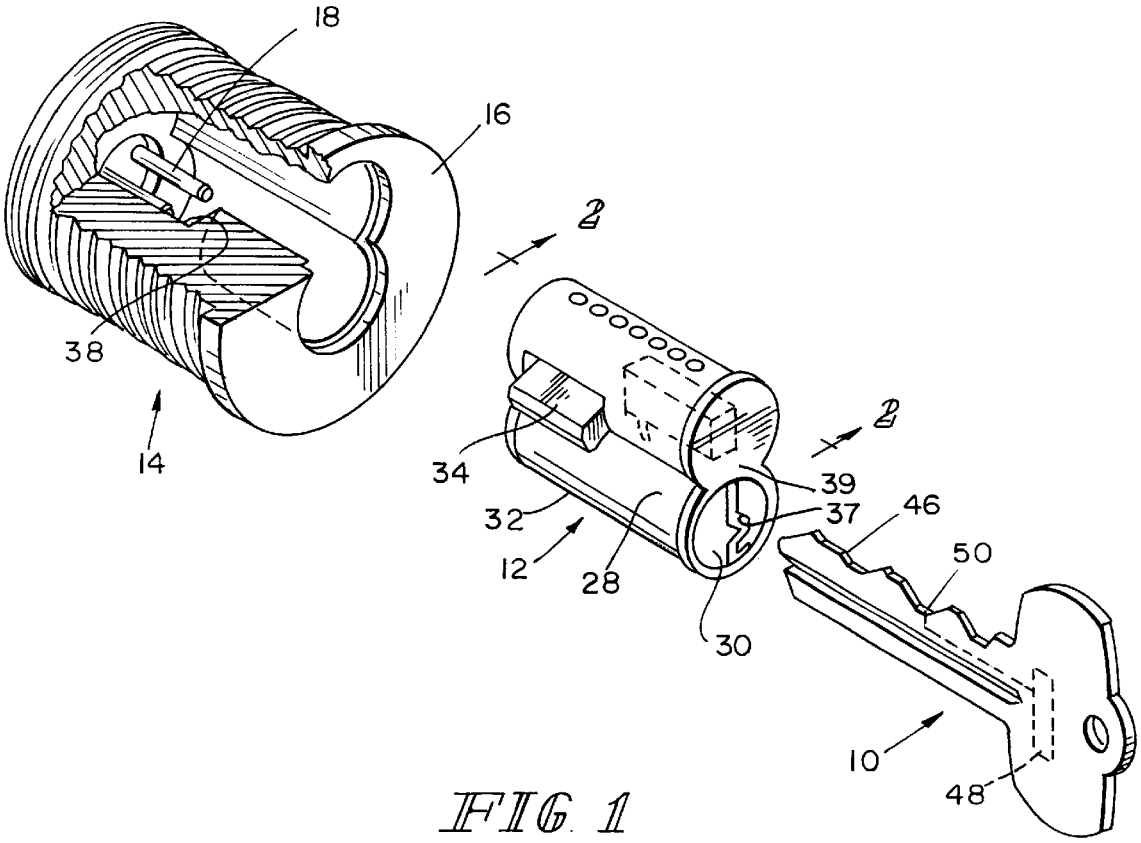
FIG. 1 is a perspective view of a token, a lock core, and a lock cylinder, the lock cylinder being formed to include an aperture to receive the lock core, and the lock core being formed to include a passageway to receive the token.

An electronic token 10 and lock core 12 in accordance with the present invention are shown in FIG. 1. The electronic token 10 and lock core 12 are components of a lockset that is installed in an entryway to restrict access through the entryway to valid individuals. The electronic token 10 and core 12 may include mechanical, electrical, and/or electrical/mechanical features that are used to grant or deny access to the user of the token 10. The electronic lock core 12 is interchangeable with a conventional lock core as shown, for example, in U.S. Pat. Nos. 4,444,034, 4,386,510, and 4,424,693. Thus, to change from a conventional mechanical lock core to the electronic lock core 12, a user must simply remove the mechanical lock core from the lock cylinder 14 and insert the electronic lock core 12 in the same lock cylinder 14.

Additional lockset components shown in FIG. 1 include a conventional lock cylinder 14 having a lock core-receiving aperture 16 and a throw member 18. In alternative embodiments of the present invention, the cylinder may be replaced by a padlock or any other type of closure or housing that accepts lock cores 12. Throw member 18 is a conventional lockset component and functions to transfer rotation or any type of movement induced by a token from lock core 12 to the rest of a lockset. In alternative embodiments, the throw member 18 may be replaced with any type of mechanism that performs the function of transferring rotation from the lock core 12 to the rest of the lockset.

The electronic lock core 12 and token 10 operate as a standalone unit and thus lock core 12 does not need to be hard-wired into an electrical system. All power required by lock core 12 and token 10 come from lock core 12 and token 10. In addition, any other features of the locking system such as access tracking, recombination, clock, display feedback, etc. must be contained within the token 10 and/or lock core 12.

Figure 2:
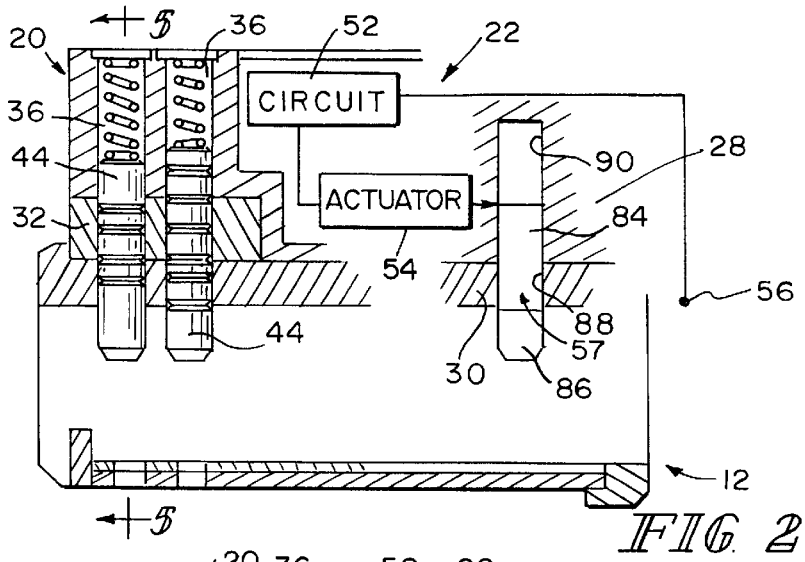
FIG. 2 is a sectional view, taken along line 2—2 of FIG. 1, showing the lock core including a mechanical portion having two tumbler pin barrels on the left side of the lock core and an electrical portion having a circuit, actuator, and mechanical linkage.
Figure 3:
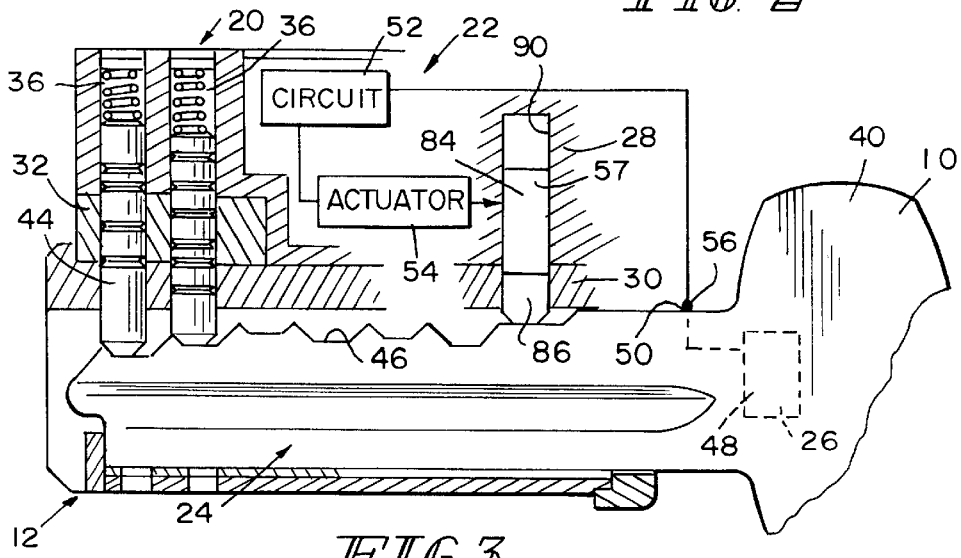
FIG. 3 is a sectional view similar to FIG. 2 showing the token positioned to lie in the passageway formed in the lock core, the token including a mechanical portion (bitted blade) and an electrical portion (phantom lines), the mechanical portion of the token interacting with the mechanical portion of the lock core, and the token engaging the mechanical linkage of the electrical portion of the lock core.
Figure 4:
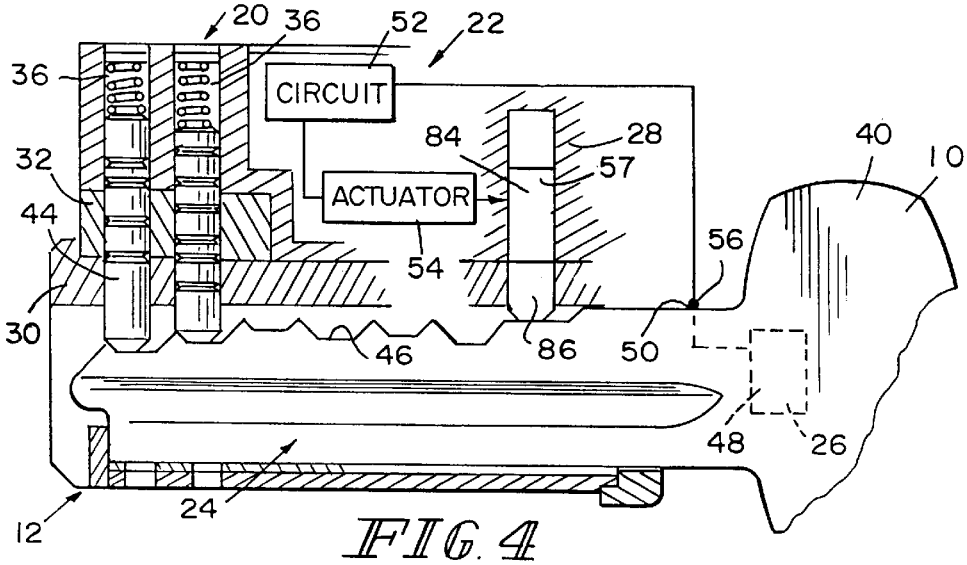
FIG. 4 is a sectional view similar to FIGS. 2 and 3 showing the circuit and actuator moving the mechanical linkage to permit the token to operate the lock core.

The lock core 12 includes a mechanical portion 20 and an electrical portion 22 that must be satisfied to permit an individual access through the entryway restricted by lock core 12 as shown in FIGS. 2–4. The token 10 also includes a mechanical portion 24 and an electrical portion 26 that cooperate with the mechanical and electrical portions 20, 22 of the lock core 12 to determine if the user of token 10 is permitted to operate the lockset.

Lock core 12 includes a core body 28, a key plug or lock actuator 30 positioned to lie in core body 28, a control sleeve 32 positioned to lie in core body 28, a control lug 34 coupled to control sleeve 32, pin tumbler barrels 36 positioned to lie partially in core body 28 and partially in the key plug 30, and a face plate 39 as shown, for example, in FIGS. 1–7. The pin tumbler barrels 36 comprise the mechanical portion 20 of lock core 12.

Figure 6:
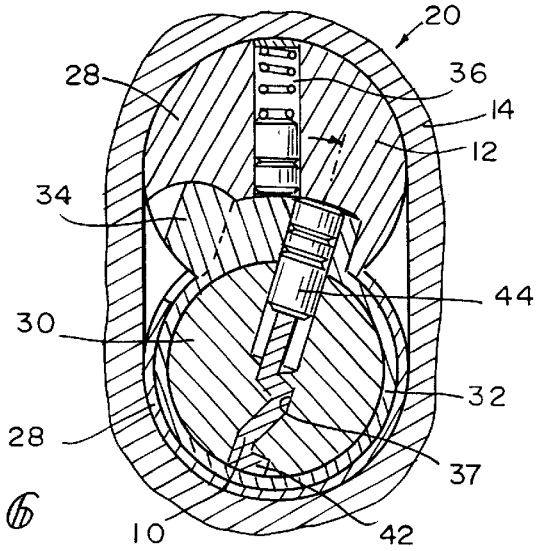
FIG. 6 is a sectional view similar to FIG. 5 showing a control token inserted into the lock core and biasing the tumbler pins so that rotation of the control token rotates the control sleeve and key plug relative to the core body.
Figure 7:
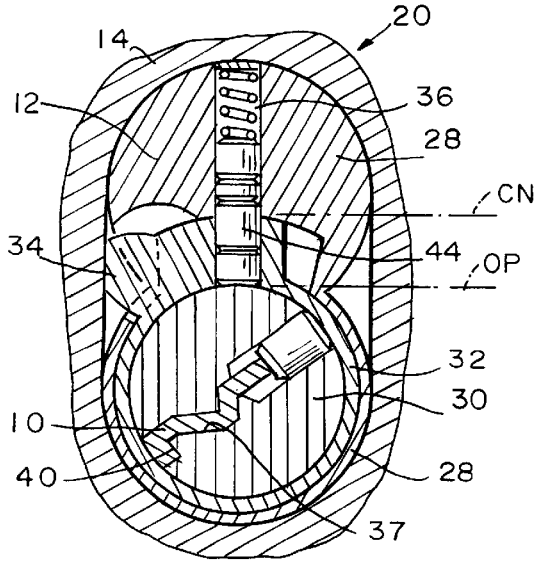
FIG. 7 is a sectional view similar to FIG. 6 showing an operating token inserted into lock core and biasing the tumbler pins so that rotation of the operating token rotates the key plug relative to the control sleeve and core body.

Key plug 30 is formed to include a keyway 37 that receives token 10. Keyway 37 is in communication with pin tumbler barrels 36. Key plug 30, control sleeve 32, and control lug 34 are rotatable relative to core body 28 by a token 10 as shown in FIGS. 6 and 7. The key plug 30 can be rotated by itself as shown in FIG. 7 and the key plug 30, control sleeve 32, and control lug 34 can be rotated together relative to core body 28 as shown in FIG. 6. When key plug 30 is rotated by itself, token 10 is permitted to rotate throw member 18 and thus cause the lockset to lock or unlock as desired.

Key plug 30 is one type of lock actuator that transfers movement induced by a token to move a door latch or other component of a lockset. In alternative embodiments of the present invention, key plug 30 may be linearly movable with respect to core body 28 to move a door latch or other component of the lockset.

Figure 5:
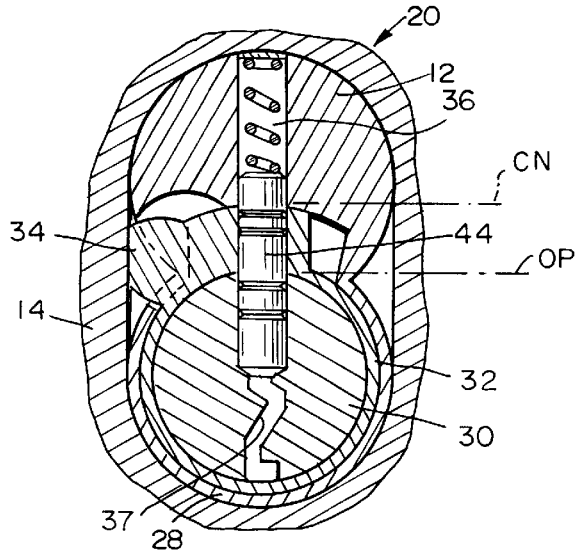
FIG. 5 is a sectional view taken along line 5—5 of FIG. 2 showing the lock core including a core body, a key plug positioned to lie within the core body and formed to include the passageway to receive the token, a control sleeve positioned to lie between the core body and key plug, a control lug appended to the control sleeve, and tumbler pins coupling the core body, control sleeve, and key plug together.

When control sleeve 32 and control lug 34 are rotated with key plug 30, control lug 34 is moved in and out of a recess 38 formed in lock cylinder 14 as shown in FIGS. 1 and 5–7. When control lug 34 is positioned to lie in recess 38 as shown in FIGS. 5 and 7, lock core 12 is securely held within lock cylinder 14. When control lug 34 is positioned to lie out of recess 3 8 as shown in FIG. 6, lock core 12 may be slid out of lock cylinder 14.

To rotate key plug 30 alone and, alternatively, control sleeve 32, control lug 34, and key plug 30 together, two different tokens are used with lock core 12. One of the tokens is referred to as an operating token 40 and is used when a user wants to rotate key plug 30 alone to cause the lockset to lock and unlock. The second token is referred to as a control token 42 and is used when a user wants to rotate key plug 30, control sleeve 32, and control lug 34 to move control lug 34 in and out of recess 38 formed in lock cylinder 14. The operating and control tokens 40, 42 cooperate with tumbler pins 44 positioned to lie in pin tumbler barrels 36 to determine if key plug 30 is rotated alone or together with control sleeve 32 and control lug 34.

Before a token 40, 42 is inserted into keyway 37 of key plug 30, tumbler pins 44 couple key plug 30 and control sleeve 32 to core body 28 as shown, for example, in FIGS. 2 and 5. When tumbler pins 44 are aligned in this manner, key plug 30 and control sleeve 32 are prevented from rotating relative to core body 28.

The operating token 40 engages tumbler pins 44 to align the faces of tumbler pins 44, as shown in FIGS. 2, 3, and 7, so that control sleeve 32 is coupled to core body 28 through tumbler pins 44 and key plug 30 is not coupled to core body 28 or control sleeve 32. This alignment of tumbler pins 44 by operating token 40 permits key plug 30 to rotate alone if all other locking systems of lock core 12 such as electrical portion 22 of lock core 12 are satisfied by operating token 40.

The control token 42 engages tumbler pins 44 to align the faces of tumbler pins 44 as shown in FIG. 6 so that control sleeve 32 is coupled to key plug 30 through tumbler pins 44 and neither key plug 30 nor control sleeve 32 is coupled to core body 28. This alignment of tumbler pins 44 by control token 42 permits key plug 30, control sleeve 32, and control lug 34 to rotate together if all other locking systems of lock core 12 such as electrical portion 22 of lock core 12 are satisfied by control token 42.

Figure 8:
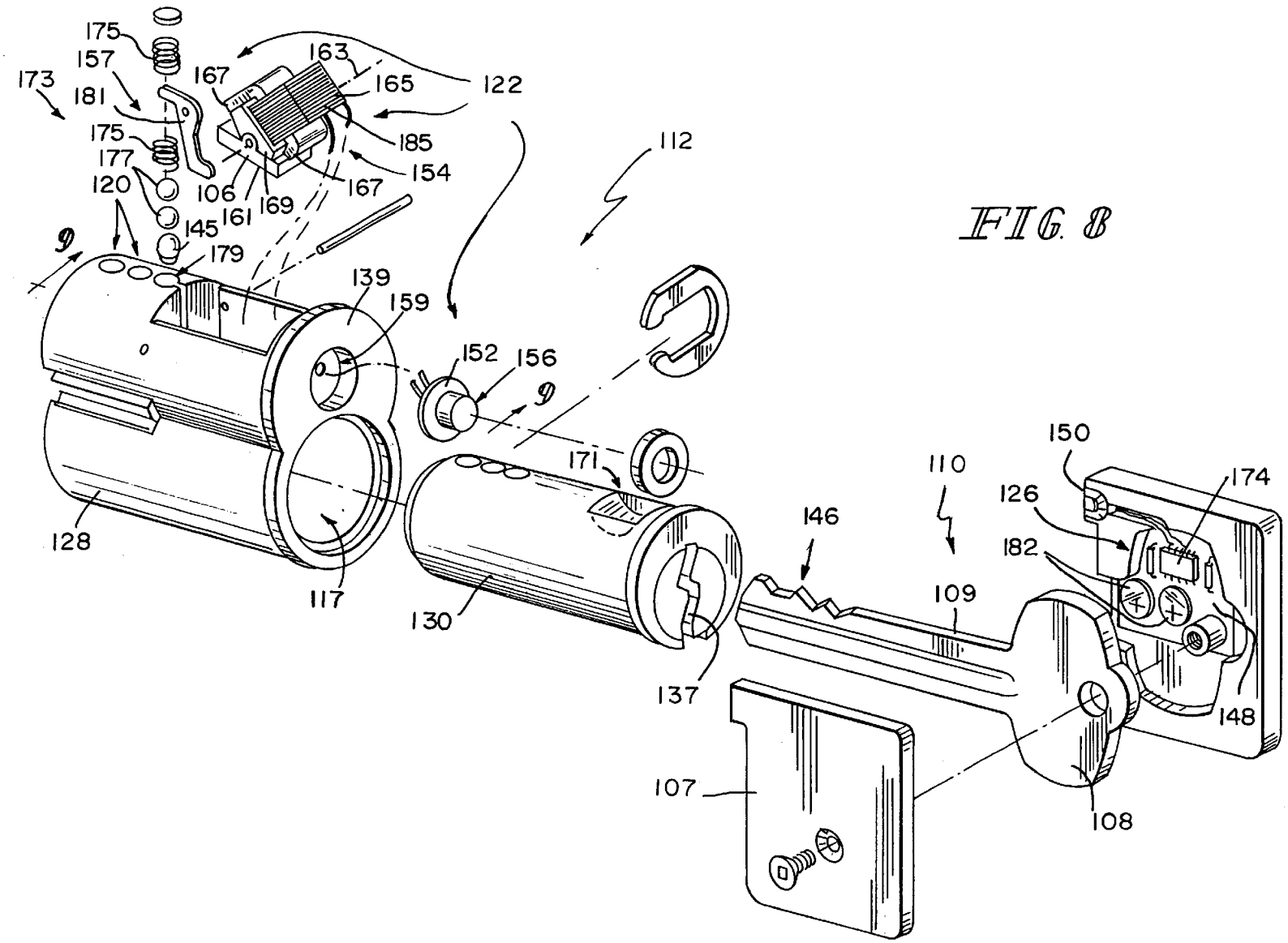
FIG. 8 is an exploded view of a preferred embodiment of an electronic token and lock core showing the lock core including a core body, a mechanical linkage having an energy storage system comprised of springs, bearings, and a cantilevered arm for insertion into the core body, an electromagnetic actuator having a blocker armature for mounting within the core body, a signal-receiving element to be located in a cavity formed in the front face of the core body, and a key plug having a blocker-receiving cavity and a keyway for insertion in the core body and showing the token including a bow and a bitted blade for receipt in the keyway, a casing for attachment to the bow, and a power supply and code storage elements lying in the casing.

The lock core 12 shown in FIG. 1 is a "figure-8 shaped" lock core 12. In alternative embodiments of the present invention, lock cores of other shapes, sizes, and configurations may incorporate the features disclosed in the present invention. For example, many European lock cores have a shape referred to as a Euro-core design. Additional details relating to lock cores 12 that can be used with the present invention are found, for example, in U.S. Pat. Nos. 4,444,034, 4,424,693, and 4,386,510 and are incorporated herein by reference.

The mechanical portion 24 of token 10 includes a bitted blade 46 and the electrical portion 26 includes a circuit 48 and contact or coupling 50. The mechanical portion 20 of lock core 12 includes pin tumbler barrels 36 and tumbler pins 44 that cooperate with bitted blade 46 of token 10. The operation of pin tumbler barrels 36 and tumbler pins 44 are discussed in detail in U.S. Pat. Nos. 4,444,034, 4,424,693, and 4,386,510 and are incorporated herein by reference. In alternative embodiments, the mechanical portion 24 of the lock core 12 and token 10 may include any type of mechanism in the lock core that the token must actuate before a user is granted access.

The electrical portion 22 of lock core 12 includes a circuit 52, an actuator 54, a contact and coupling 56, and a mechanical linkage 57. The circuit 52 of lock core 12 and circuit 48 of token 10 communicate through contacts 50, 56. Many types of contacts 50, 56 can be used and placed in many different locations on lock core 12 and token 10. These contacts 50, 56 include ohmic and inductive contacts as discussed in provisional patent application Ser. No. 60/080974 filed Apr. 7, 1998 that is expressly incorporated by reference herein.

The circuit 52 of lock core 12 may include various combinations of a token identification reader or token communicator, a lock operator, a recombination system, a token access history, a clock, a power source, a power conditioner, and a power distributor. The circuit 48 of token 10 may include various combinations of token identification information or access code 74, token access history, clock, and power source 82. Various lock core 12 and token 10 configurations having different combinations of the above-mentioned features are illustrated and described in U.S. provisional patent application Ser. No. 60/080974 filed Apr. 7, 1998 that is expressly incorporated by reference herein.

Before a token 10 is inserted into lock core 12, mechanical linkage 57 couples key plug 30 and core body 28 as shown in FIG. 3. The engagement between token 10 and mechanical linkage 57 provides energy to mechanical linkage 57 to later assist in moving mechanical linkage 57 if acutator 54 permits mechanical linkage 57 to move. The energy supplied to mechanical linkage 57 by token 10 can be stored by a spring, piezoelectric material/capacitor, elastic material, or other suitable device. In alternative embodiments, the mechanical linkage does not contact the token to receive energy.

After circuit 52 verifies that token 10 should be granted access, actuator 54 moves mechanical linkage 57 to a position shown in FIG. 4 to permit key plug 30 to rotate relative to core body 28 if the mechanical portion 20 of lock core 12 is also satisfied by token 10. In the illustrated embodiment, the mechanical linkage 57 includes first and second portions 84, 86 that can be separated. When circuit 52 verifies that token 10 should be granted access, actuator 54 positions mechanical linkage 57 so that the abutting faces of portions 84, 86 are positioned to lie at the intersection of core body 28 and key plug 30 and key plug 30 can rotate relative to core body 28. In alternative embodiments, when circuit 52 verifies that the token should be granted access, actuator 54 removes the entire mechanical linkage from the key plug to permit the key plug to rotate relative to the core body.

Because lock core 12 includes pin tumbler barrels 36, token 10 cannot be removed until the token is returned to the same position at which it was inserted as shown in FIG. 3. When token 10 is returned to this position, mechanical linkage 57 moves through chambers 88, 90 without assistance from actuator 54 to couple key plug 30 and core body 28 to prevent key plug 30 from rotating.

Referring specifically to FIGS. 8–11, a first embodiment of lock core 112 and token 110 are illustrated. Electronic lock core 112 includes a core body 128 having an aperture 117, a key plug or lock actuator 130 sized to be received in the aperture 117 and formed to include a keyway 137, a mechanical portion 120, and an electrical portion 122. Mechanical portion 120 includes two pin tumbler barrels 136 each containing tumbler pins 144 partially extending into keyway 137 and blocking rotation of key plug 130 relative to core body 128, as shown, for example, in FIG. 9, unless a token 110 containing an appropriately bitted blade 146 is inserted in keyway 137, as shown, for example in FIGS. 10–11.

Electrical portion 122 of lock core 112 includes a mechanical linkage 157, an electromagnetic actuator 154, a token communicator or coupling 156, and a circuit 152. Coupling 156 and circuit 152 are received in a cavity 159 formed in face plate 139 of core body 128. Electromagnetic actuator 154 includes an armature 161 pivotally supported for movement between first and second angularly displaced positions about a pivot axis 163 extending though center of mass 106 of armature 161, an electromagnet 165 having a pair of opposed pole members 167 extending toward the ends of armature 161 on either side of pivot axis 163, and a three pole permanent magnet 169 extending between pole members 167 of electromagnet 165. Armature 161 is received in a blocker-receiving channel 171 of key plug 130 to block rotation of key plug 130 relative to core body 128 when in the first position. Permanent magnet 169 biases armature 161 in the first position. When armature 161 is in the second position, it is not received in the blocker-receiving channel 171 and key plug 130 is permitted to rotate relative to core body 128.

Mechanical linkage 157 includes an energy storage system 173 having a spring 175, a semi-spherical tumbler pin 145 having a first end 104 extending into key way 137 and a spaced apart second end 105 and spherical tumbler pins 177 each including a downwardly facing semi-spherical surface for insertion into a barrel 179 partially formed in core body 128 and partially formed in key plug 130, and a cantilevered arm 181 for insertion into a cavity 183 in core body 128 in communication with barrel 179. Semi-spherical tumbler pin 145 includes a first end 104 extending into key way 137 and a spaced apart second end 105 engaging one of spherical tumbler pins 177. Each spherical tumbler pin 177 includes a downwardly facing semi-spherical surface.

Semi-spherical tumbler pin 145 and spherical tumbler pins 177 are utilized so that tumbler alignment in mechanical linkage 157 does not have to be as precise as the alignment of tumbler pins 144 in mechanical portion 120 in permitting key plug 130 rotation. So long as the downwardly facing semi-spherical surface of one of spherical pins 177 is located at the interface of core body 128 and key plug 130, rotation of key plug 130 will urge that spherical pin 177 upwardly until it is completely positioned within the portion of barrel formed in core body 128. Thus, the location of armature 161 with respect to blocker-receiving channel 171, and not the location of semi-spherical tumbler pin 145 and spherical tumbler pins 177, determines whether electrical portion 122 inhibits rotation of key plug 130 relative to core body 128. In alternative embodiments, the electrical portion includes tumbler pins similar to tumbler pins 144 instead of pins 145, 177 so that both the location of the armature 161 and the pins determine whether the requirements of the electrical portion are satisfied. Similar barrels 279, 379, 479, and 579, pins 245, 277, 345, 377, 445, 477, 545 and 577 are found in the lock core embodiments 212, 312, 412, and 512 described hereinafter to serve similar functions.

While FIG. 1 illustrates circuitry 48 and contact 50 integrally formed into the bow of electronic token 10, a presently preferred embodiment of electronic token 110 includes a standard mechanical token 109 having a bitted blade 146 and a bow 108 and a case 107 designed to encase bow 108, as shown, for example, in FIG. 8. Case 107 contains the electrical portion 126 of token 110. Standard token 109 is designed so bitted blade 146 may be received in keyway 137 of key plug 130. Illustratively electrical portion 126 includes a power supply 182, a coupling 150, incorporated previously by reference, and token identification information 174. Alternative forms of cases 607, 707, 807 and 907 for attachment to standard token bows are shown, for example, in FIGS. 25–28, respectively.

Figure 9:
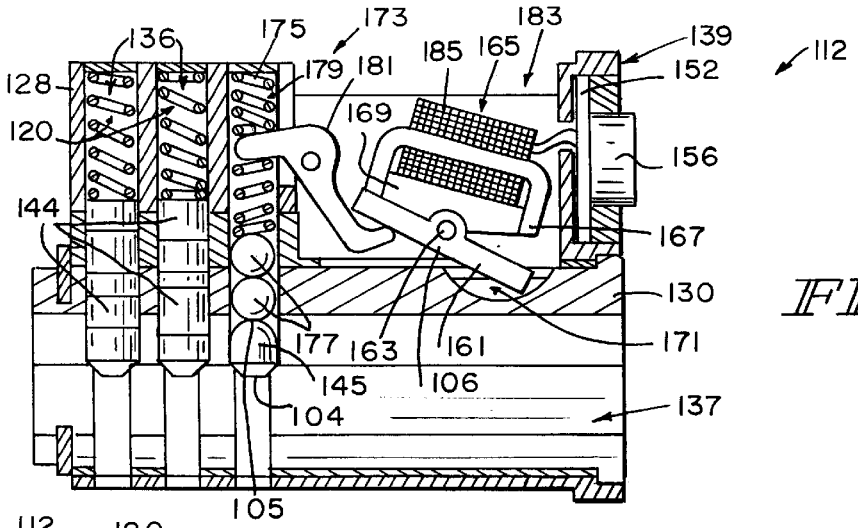
FIG. 9 is a sectional view taken along line 9—9 of FIG. 8 showing the lock core including a mechanical portion having two tumbler pin barrels each containing tumbler pins partially extending into the keyway and blocking rotation of the key plug relative to the core body and an electrical portion including the blocker of the electromagnetic actuator received in the blocker-receiving channel of the key plug to block rotation of the key plug relative to the core body.

Prior to token 110 insertion, tumbler pins 144 partially extend into keyway 137 and block rotation of the key plug 130 relative to core body 128 as shown in FIG. 9. Rotation of key plug 130 relative to core body 128 is also blocked by armature 161 of electromagnetic actuator 154 which is received in blocker-receiving channel 171 of key plug 130, as shown, for example, in FIG. 9. Armature 161 is inhibited from pivoting out of blocker-receiving channel 171 by cantilevered arm 181, as well as by permanent magnet 169.

Figure 10:
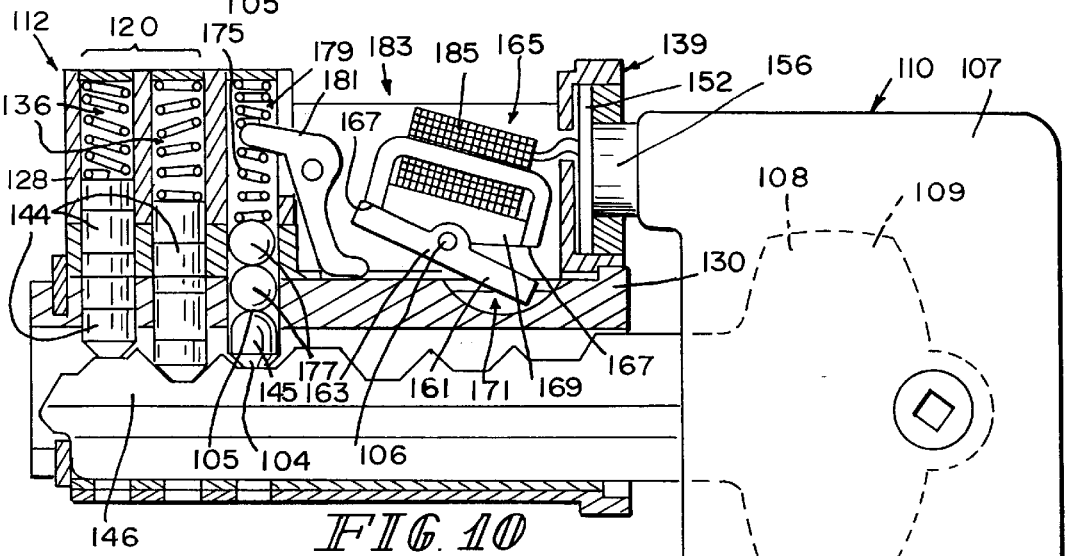
FIG. 10 is a sectional view similar to FIG. 9 with a token of FIG. 8 inserted into the keyway showing the bitted blade of the token aligning the tumbler pins of the mechanical portion of the lock core so that the tumbler pins no longer inhibit rotation of the key plug within the core body and compressing the springs and rotating the cantilevered arm of the electrical portion of the lock core to store energy within the springs and showing the blocker armature of the electromagnetic actuator still being received in the blocker receiving cavity but being free to rotate out of the blocker receiving cavity upon receipt of an authorized access signal by the electromagnetic actuator from the circuit after interrogating identification information on the token.
Figure 11:
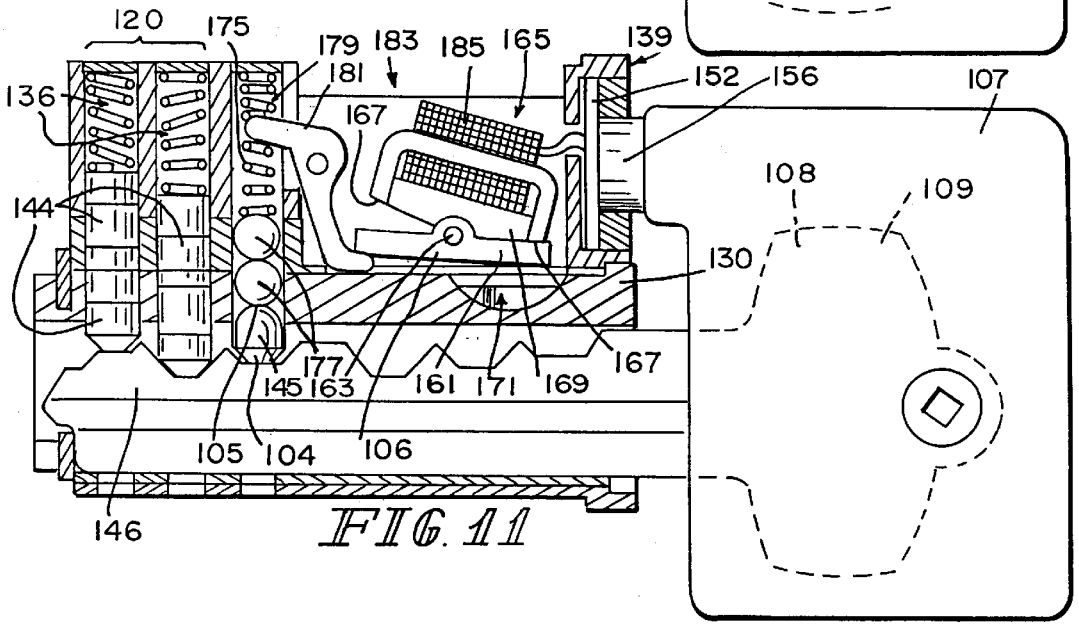
FIG. 11 is a sectional view similar to FIG. 10 showing the blocker armature of the electromagnetic actuator rotated out of the blocker receiving cavity after receipt of an appropriate code from the token allowing the key plug to rotate freely within core body.

When token 110 is inserted into keyway 137 bitted blade 146 of token 110 aligns tumbler pins 144 of the mechanical portion 120 so that they no longer inhibit rotation of key plug 130 with respect to core body 128 as shown in FIG. 10. Bitted blade 146 also urges semi-spherical tumbler pin 145 upwardly compressing spring 175 and causing rotation of arm 181 out of engagement with armature 161 freeing armature 161 to move if electromagnet 165 is energized in response to a valid authorization code. Thus, immediately after insertion of token 110, armature 161 of electromagnetic actuator 154 is still received in blocker-receiving cavity 171 but is free to rotate out of blocker-receiving cavity 171 upon lock core 112 receiving an authorized access signal from token 110, as shown, for example, in FIG. 10.

Compressed spring 175 stores energy which is used to urge arm 181 back into its initial position upon removal of token 110 from keyway 137, as shown in FIG. 9. This stored energy facilitates the return of armature 161 of electromagnetic actuator 154 to its blocking position in blocker-receiving slot 171.

If token 110 contains token identification information 174 which is authorized to open lock, coil 185 of electromagnet 165 is energized causing armature 161 of electromagnetic actuator 154 to be rotated out ofthe blocker-receiving cavity 171. Electromagnetic actuator 154 requires only a short energy pulse or trigger pulse to pivot armature 161 to the non-blocking position of FIG. 11. Once pivoted to the non-blocking position, armature 161 remains in that position without continued coil 185 energization. As a result, energy consumption of electronic lock core 112 is minimized extending the life of batteries used as a power source 182. Operation of a similar electromagnetic actuator 154 is described in depth in Ono et al. U.S. Pat. No. 4,703,293, the disclosure of which is incorporated herein by reference.

After the lockset has been configured to grant access to the authorized user, user removes token 110 from keyway 137 allowing the energy stored in compressed spring 175 to rotate arm 181 which pivots armature 161 of electromagnetic actuator 154 into its blocking position shown in FIG. 10. No electrical energy is required to return armature 161 to its blocking condition further extending the battery life of power source 182.

Figure 12:
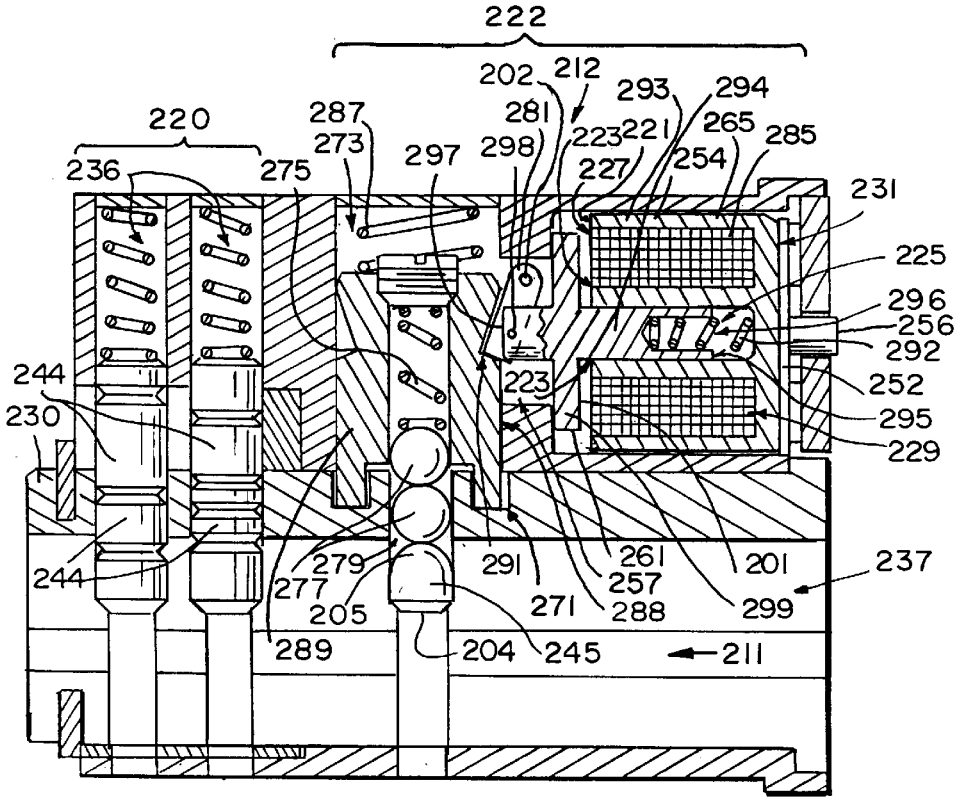
FIG. 12 is a sectional view of another preferred embodiment of a lock core showing the lock core including a core body, a key plug having a keyway therethrough, a mechanical portion having two tumbler pin barrels each containing tumbler pins extending into the keyway and positioned to prohibit rotation of the key plug relative to the core body, and an electrical portion having a mechanical energy storage mechanism comprised of a tumbler ball bearing, springs, a blocking body having a step formed therein, a latch engaging the step of the blocking body, and an electromagnetic actuator controlling movement of the latch.
Figure 13:
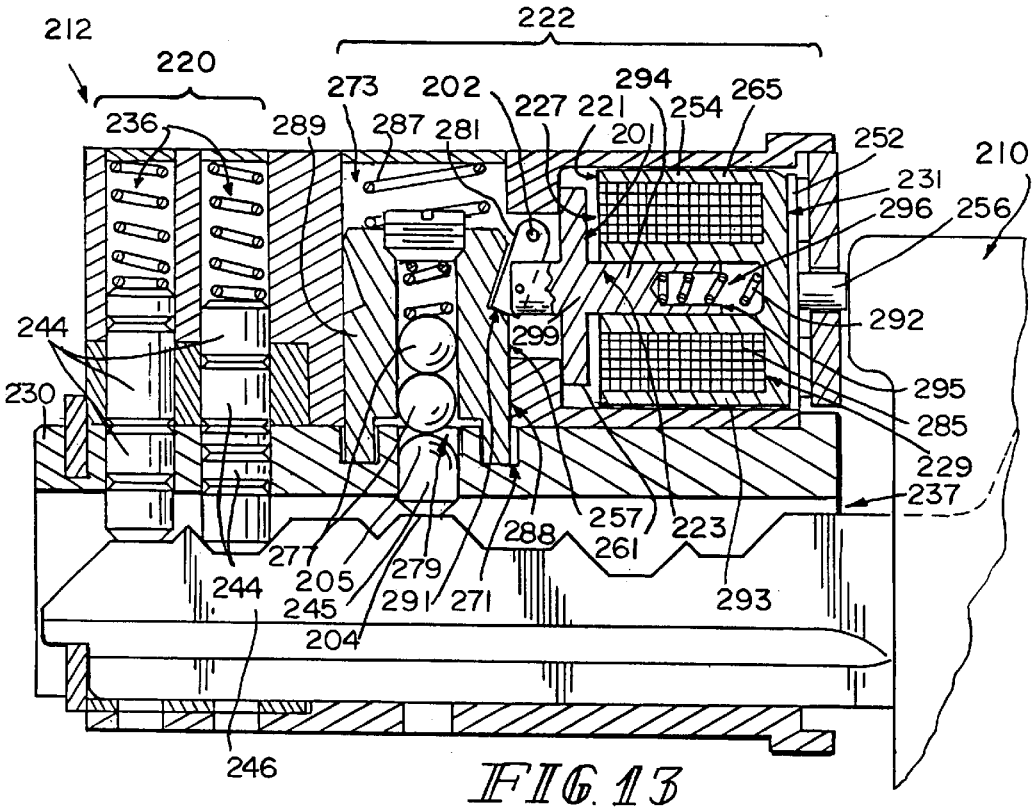
FIG. 13 is a sectional view similar to FIG. 12 with the token of FIG. 8 inserted in the keyway of the key plug so that the bitted blade has positioned the tumbler pins of the mechanical portion in a position which does not inhibit rotation of the key plug relative to the core body and stored energy in the spring of the electrical portion.
Figure 14:
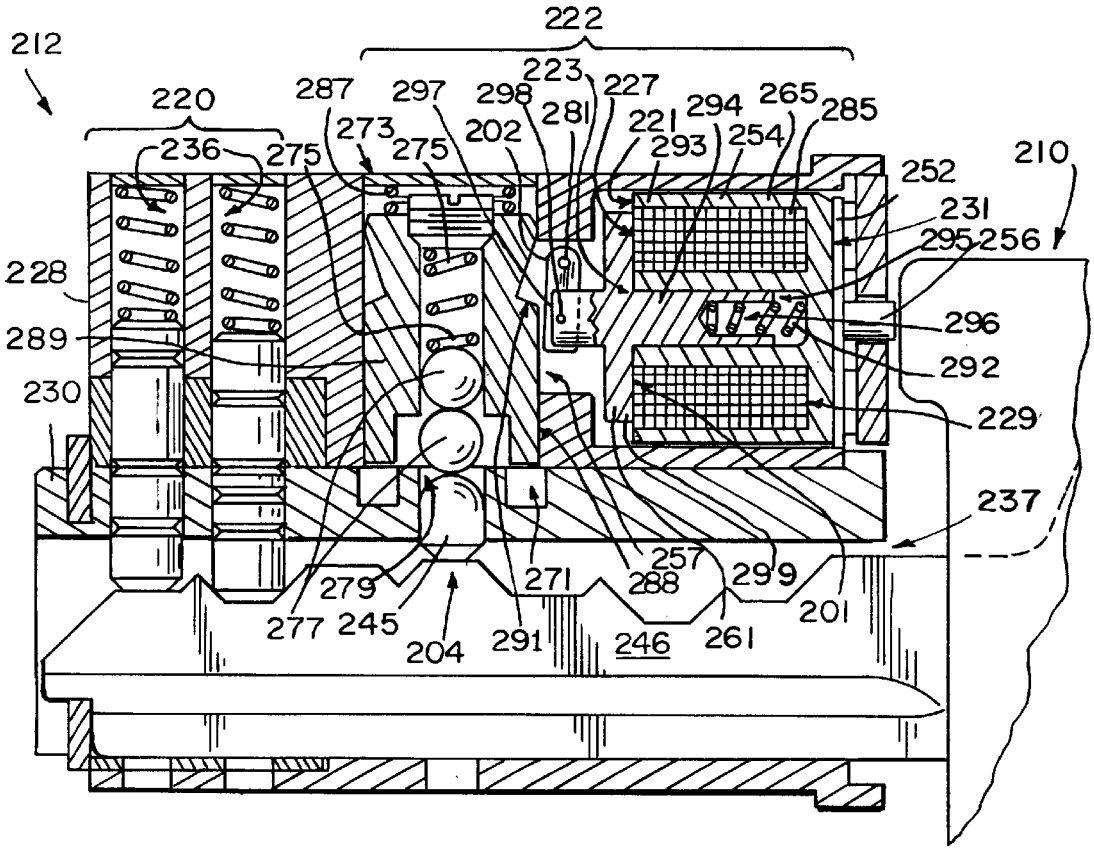
FIG. 14 is a sectional view similar to FIG. 13 after the electromagnetic actuator has been energized in response to the receipt of a valid access code from the token and has disengaged the latch from the step formed in the blocking body to allow energy stored in the lower spring to urge the blocking body into a position in which it no longer inhibits rotation of key plug with respect to core body.
Figure 15:
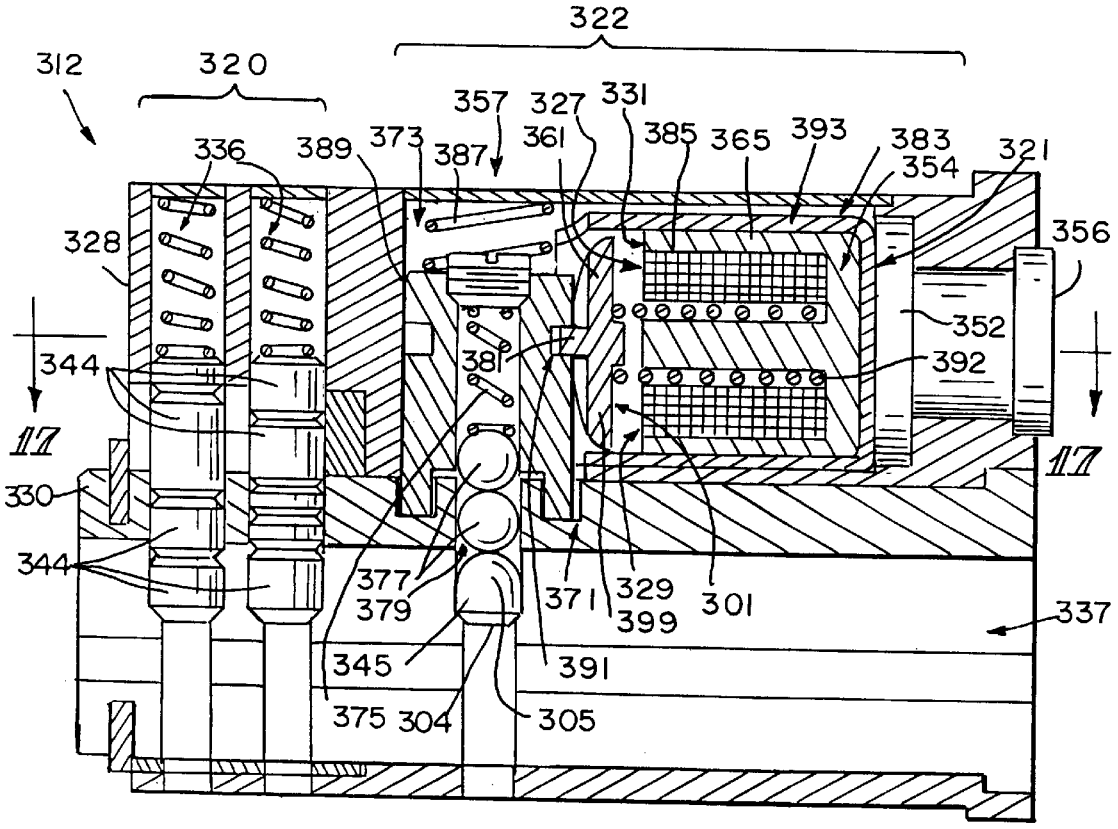
FIG. 15 is a sectional view of yet another preferred embodiment of an electronic lock core including a mechanical portion having two tumbler pin barrels each containing tumbler pins partially extending into the keyway and blocking rotation of the key plug relative to the core body and an electrical portion including a flange coupled to a disk that is pivotally attached to an electromagnet extending into a channel to hold the blocker body in a blocker-receiving cavity of the key plug and block rotation of the key plug relative to the core body.
Figure 16:
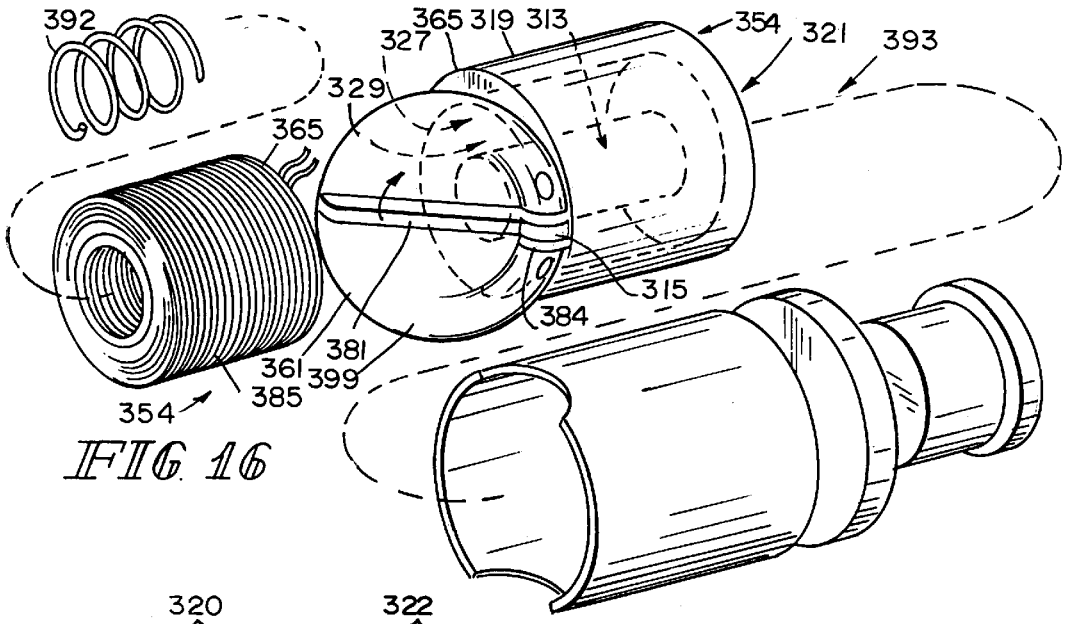
FIG. 16 is an exploded view of the electromagnetic actuator of FIG. 15 showing a core of an electromagnet into which a coil is inserted and a ferrous disk having the flange for receipt in the indentation in the blocker body that is pivotally mounted to the electromagnet.
Figure 17:
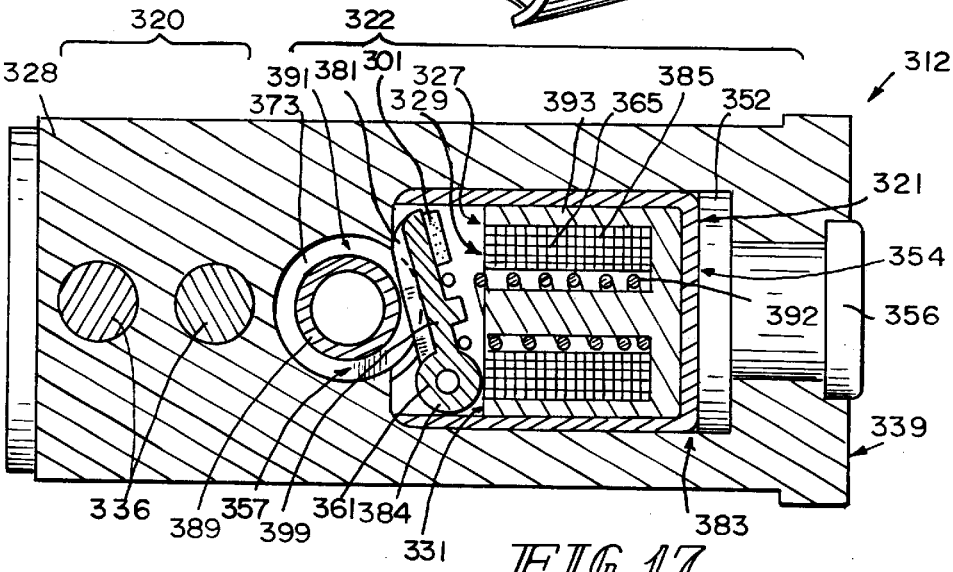
FIG. 17 is a sectional view taken along line 17—17 of FIG. 15 showing the flange of the ferrous disk received in the indentation in the blocker to prevent movement of the blocker and also showing a mechanical portion similar to that shown in FIGS. 9–11.
Figure 18:
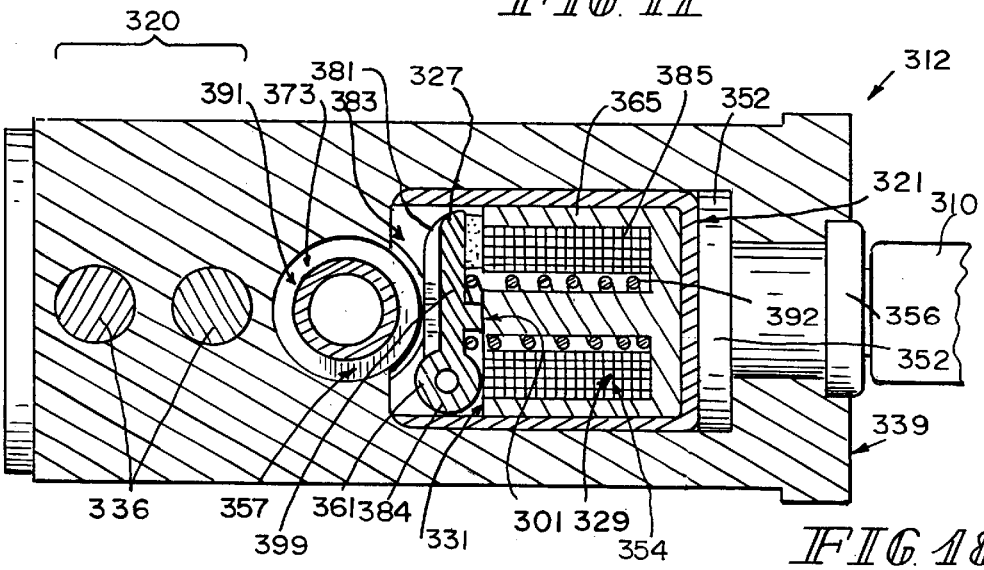
FIG. 18 is a sectional view similar to FIG. 17 with a token as shown in FIG. 8 inserted in the keyway showing the electromagnet energized in response to an authorized code to pivot the flange to a position allowing movement of energy storage mechanism.

Referring to FIGS. 12–14, a second embodiment of the lock core 212 in accordance with the present invention is illustrated. Lock core 212 includes core body 228, a key plug or lock actuator 230 having a keyway 237 therethrough, and a mechanical portion 220 including two tumbler pin barrels 236 each containing tumblers pins 244 extending into keyway 237 and blocking rotation of the key plug 230 relative to core body 228. Lock core 212 also includes electrical portion 222 having a coupling or token communicator 256, a circuit 252, an electromagnetic actuator 254, and a mechanical linkage 257. Mechanical linkage 257 includes a mechanical energy storage system 273 having a semi-spherical tumbler pin 245, spherical tumbler pins 277, a lower spring 275, an upper spring 287, a blocking body 289 having a step 291 formed therein, a latch 281, and blocking body-receiving cavity 271 formed in key plug 230. Electromagnetic actuator 254 is coupled to latch 281 to control the movement of latch 281 between a position lying in step 291 of blocker body 289 and a position away from step 291.

When token 210 is inserted into keyway 237 of key plug 230, bitted blade 246 positions tumbler pins 244 of mechanical portion 220 so they do not inhibit rotation of the key plug 230 relative to the core body 228 as shown in FIG. 13. Bitted blade 246 also engages semi-spherical tumbler pin 245 and urges it, and spherical tumbler pins 277, upwardly to compress lower spring 275. After token 210 insertion, but prior to receiving an authorized code, latch 281 is positioned in step 291 preventing blocking body 289 from moving out of blocker body-receiving cavity 271. The energy stored in the lower spring 275 after token insertion is used to urge blocking body 289 upwardly out of blocker body-receiving cavity 271 once latch 281 is urged away from step 291.

After electromagnetic actuator 254 has been energized in response to the receipt of a valid access code, latch 281 is momentarily disengaged from step 291 allowing energy stored in lower spring 275 to urge blocking body 289 into a position in which it no longer inhibits rotation of key plug 230 with respect to core body 228 as shown in FIG. 14. The upward movement of blocking body 289 stores mechanical energy in upper spring 287 which is later used to return blocking body 289 to its blocking position upon removal of token 210 as shown in FIG. 12.

Electromagnetic actuator 254 includes a core 293, a movable element 261, and a spring 292 biasing the movable element 261 away from the core 293. Core 293 has a first end 221 having a cross-sectional area (not shown) and formed to include a circular opening 223 therethrough communicating with a cylindrical axial cavity 225 and a ring-shaped opening 227 therethrough communicating with an annular cavity 229, a closed second end 231, and a cylindrical coil 285 received in the annular cavity 229.

Movable element 261 includes a shaft 294 having a first end 295 formed to include a spring receiving cavity 296, a second end 297 having a connector hole 298 extending therethrough, and a disk 299 extending radially from the shaft 294 between the first end 295 and second end 297. Disk 299 has a surface 201 facing first end 221 of electromagnet 265 which has a cross-sectional area substantially similar to cross-sectional area of first end 221 of electromagnet 265. First end 295 of movable element 261 is received in cylindrical axial cavity 225 of core 293. Spring 292 is received in spring-receiving cavity 296 and engages closed second end 231 of core 293 to bias disk 299 away from first end 231 of core 293. Second end 297 of shaft 294 is connected by a fastener to latch 281 which is pivotally mounted about pivot axis 202 to lock core 212. Second end 297 is connected to latch 281 at a point spaced apart from pivot axis 202 to increase mechanical advantage.

When current flows through coil 285 of electromagnet 265 in response to receipt of an authorized code from token 210, a magnetic field is produced which attracts surface 201 of disk 299 toward first end 231 of core 293 causing latch 281 to pivot away from blocking body 289 and to disengage step 291. Blocking body 289 is immediately urged upwardly by compressed spring 275 upon disengagement of latch 281 from step 291 as shown in FIG. 14. Cessation of current flow causes shaft 294 to move in the direction of arrow 211 in FIG. 12 allowing latch 281 to pivot into engagement with sidewall 288 of blocking body 289. Upon token 210 removal upper spring 287 will urge blocking body 289 to its blocking position while allowing latch 281 to be urged into engagement with step 291 as shown in FIG. 12. Thus, current need only flow through coil 285 long enough to disengage latch 281 from step 291 momentarily so that blocking body 289 can be urged upwardly out of blocker-receiving cavity 271. Because continuous current flow through coil 285 is not required to maintain the electrical portion 222 in a state in which key plug 230 rotation with respect to core body 228 is permitted, battery 182 life can be extended.

Referring to FIGS. 15–18, a third embodiment of an electronic lock core 312 is illustrated. Electronic lock core 312 includes a core body 328, a key plug or lock actuator 330 formed to include a keyway 337, a mechanical portion 320, and an electrical portion 322. Mechanical portion 320 includes two tumbler pin barrels 336 each containing tumbler pins 344 partially extending into keyway 337 and blocking rotation of key plug 330 relative to core body 328. Electrical portion 322 includes a coupling or token communicator 356, circuit 352, an electromagnetic actuator 354, and a mechanical linkage 357. Mechanical linkage 357 includes a mechanical energy storage system 373 having a semi-spherical tumbler pin 345, spherical tumbler pins 377, lower spring 375, upper spring 387, a blocking body 389 having a channel 391 formed therein, and a blocker-receiving cavity 371 formed in key plug 330. Electromagnetic actuator 354 includes an electromagnet 365, a movable element 361 attached by a hinge coupling to electromagnet 365, and a spring 392 biasing the unattached portions of movable element 361 away from the electromagnet 365. Electromagnetic actuator 254 includes an electromagnet 365, a movable element 361 attached by a hinge coupling to electromagnet 365, and a spring 392 biasing the unattached portions of movable element 361 away from the electromagnet 365.

Movable element 361 includes a disk-shaped ferrous element 399 having an electromagnet-facing surface 301, an opposite surface having a flange 381 extending therefrom, and a mounting bracket 384 formed at one edge. Electromagnet 365 includes a core 393 and a coil 385. Core 393 includes a closed first end 321, a cylindrical outer shell 319 extending from the first end 321, a central shaft 313 extending axially from the first end 321, and a second end 331 having a mounting ear 315 extending therefrom. The core 393 is formed to include an annular opening 327 communicating with an internal cavity 329 defined by the outer shell 319, closed end 321, and central shaft 317. Mounting bracket of movable element 361 is pivotally connected to mounting ear 315 of core 393, as shown, for example, in FIG. 16 so that electromagnet-facing surface 301 is directed toward second end 331 of core 393. Coil 385 and spring 392 are received in cavity 329, as shown, for example, in FIG. 16.

Electromagnetic actuator 354 is mounted in cavity 383 of lock body 328 so that flange 381 of movable element 361 is biased toward channel 391 of blocking body 389 by spring 392. When current is induced to flow through coil 385, an electromagnetic field is generated which attracts disk 399 of movable element 361 toward second end 331 of electromagnet 365 causing flange 381 to pivot out of channel 391. If a token 310 including an appropriately bitted blade 346 has been inserted into keyway 337, mechanical energy storage system 373 compresses lower spring 375 to store energy which urges blocking body 389 upwardly out of blocker body-receiving channel 371 immediately upon removal of flange 381 from channel 391.

Figure 19:
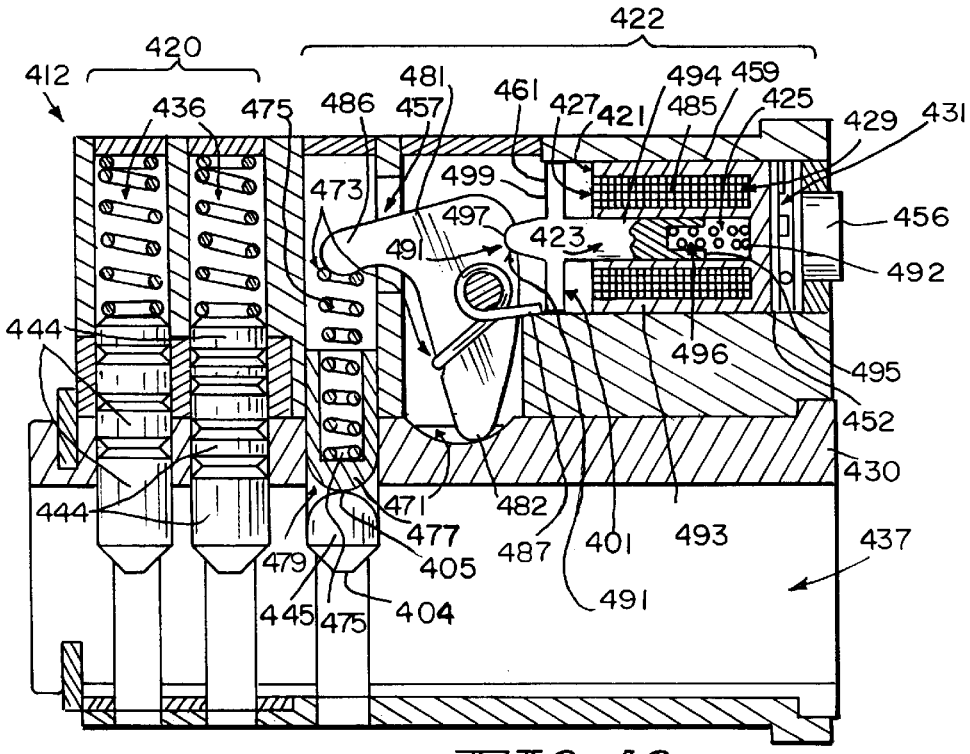
FIG. 19 is a sectional view of yet another preferred embodiment of a lock core according to the present invention, showing the lock core including a mechanical portion having two tumbler pin barrels each containing tumbler pins extending partially into the keyway and blocking the rotation of key plug with respect to core body, a mechanical energy storage device having semi-spherical ended tumblers, a coiled spring, a pivotally mounted latch with a blocker end, a storage end, and an indentation, and a torsion spring, and also showing a latch receiving cavity in the key plug with the blocker end of the latch received therein, a latch blocker having a tip received in the indentation, and an electromagnetic actuator for moving the latch blocker.
Figure 20:
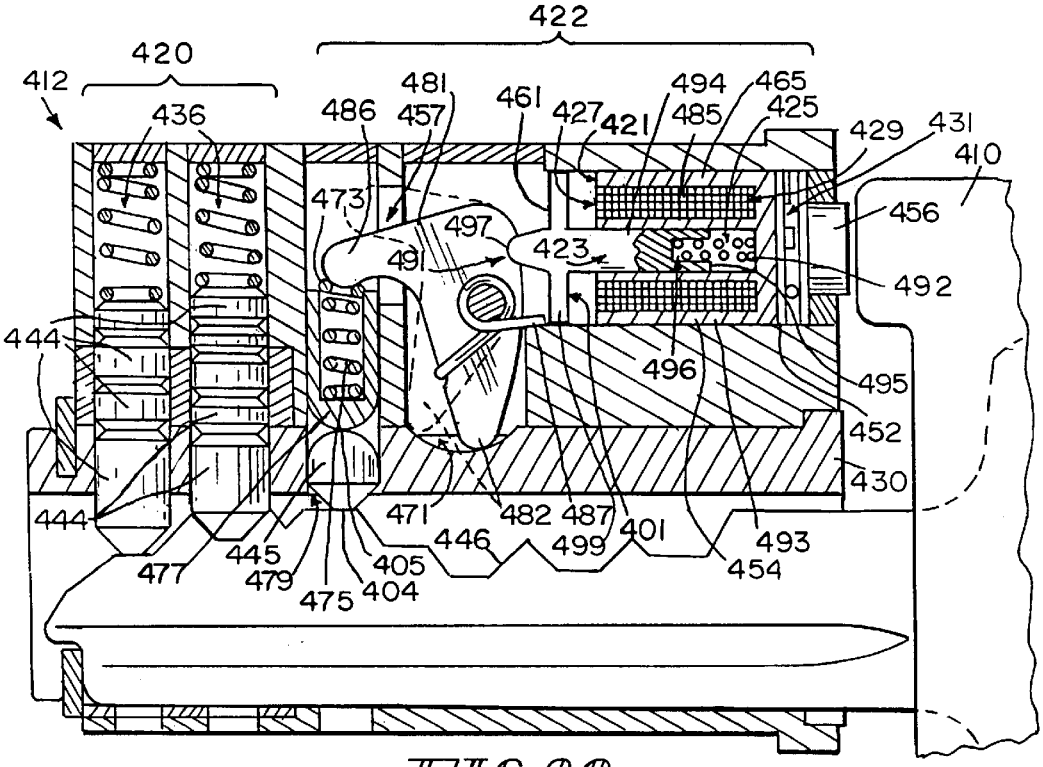
FIG. 20 is a sectional view similar to FIG. 19 with a token of FIG. 8 inserted in the keyway so that the bitted blade has positioned the tumbler pins of the mechanical portion in a position which does not inhibit rotation of the key plug relative to the core body and has urged the semi-spherical tumblers upward to store energy in the spring that may be released to urge the blocker end of latch from its current position in which it continues to inhibit rotation of the key plug with respect to the core body to a second position (shown in phantom lines) in which blocker end of latch is no longer received in the blocker receiving channel.
Figure 21:
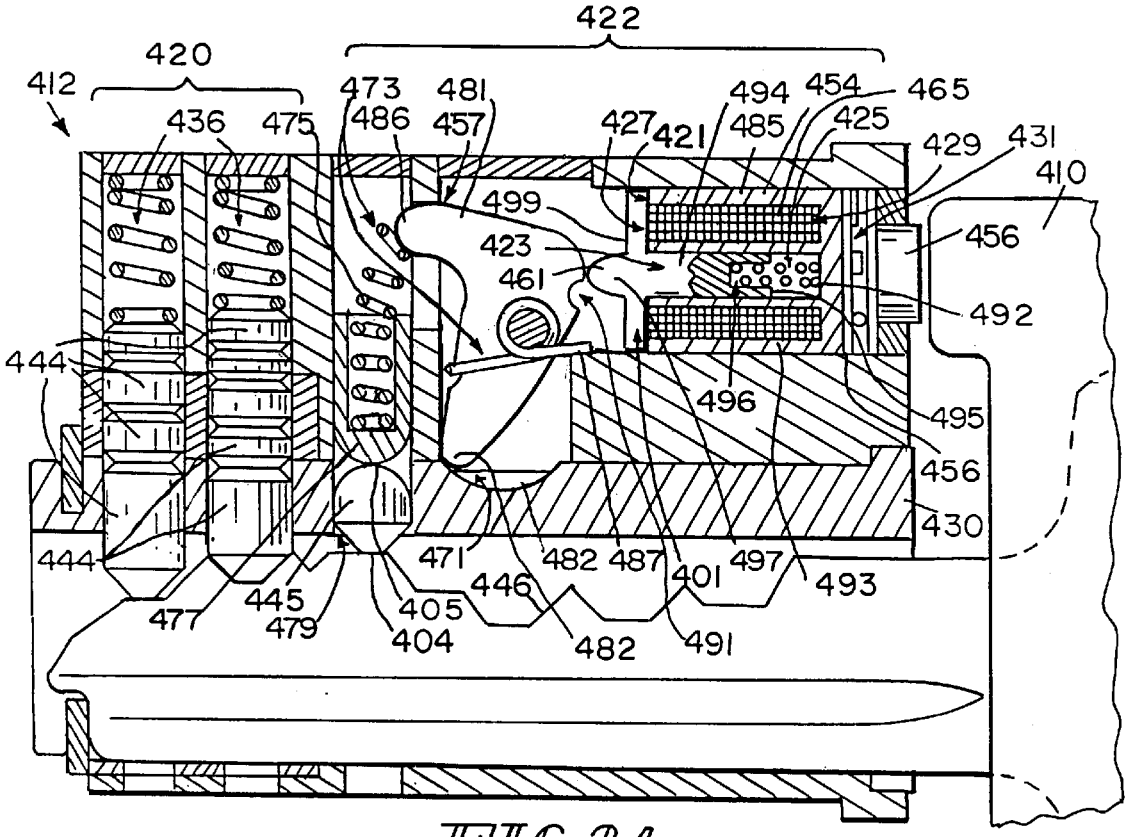
FIG. 21 is a sectional view similar to FIG. 20 showing the blocker end of the latch rotated out of the blocker receiving channel in response to removal of the tip of the latch blocker from the indentation of the latch after the electromagnet has been momentarily energized in response to receiving an authorized code to free the key plug to rotate with respect to the core body.

Referring to FIGS. 19–21 a fourth embodiment of a lock core 412 is illustrated. Lock core 412 includes mechanical portion 420 having two tumbler pin barrels 436 each containing tumbler pins 444 extending partially into the keyway 437 blocking the rotation of key plug or lock actuator 430 with respect to core body 428 and an electrical portion 422. Electrical portion 422 includes a coupling or token communicator 456, circuit 452, an electromagnetic actuator 454, and a mechanical linkage 457. Mechanical linkage 457 includes a mechanical energy storage system 473 having a semi-spherical tumbler 445, a semi-spherical ended tumbler 477, a lower spring 475, a pivotally-mounted latch 481 having a blocker end 482, a storage end 486, and an indentation 491, a torsion spring 487, and a latch-receiving cavity 471 in the key plug 430. Before, token 410 communicates with lock core 412, blocker end 482 of latch 481 is positioned in latch-receiving cavity 471 of key plug 430 to prevent rotation of key plug 430 relative to core body 428.

Electromagnetic actuator 454 includes an electromagnet 465, a movable element 461, and a spring 492. Electromagnet 465 includes a core 493 having a first end 421 formed to include a circular opening 423 therethrough communicating with a cylindrical axial cavity 425 and a ring-shaped opening 427 therethrough communicating with an annular cavity 429, a closed second end 431, and a cylindrical coil 485 received in the annular cavity 429. Movable element 461 includes a shaft 494 having a first end 495 formed to include a spring-receiving cavity 496, a pointed second end 497, and a disk 499 extending radially from the shaft 494 between the first end 495 and second end 497. First end 495 of movable element 461 is received in cylindrical axial cavity 425 of core 493. Spring 492 is received in spring-receiving cavity 496 and engages closed second end 431 of core 493 to bias disk 499 away from first end 431 of core 493. Second end 497 of shaft 494 is biased by spring 492 toward and for receipt into indentation 491 of latch 481 which is pivotally mounted to lock core 412. Coil 485 and spring 492 are received in cavity 427, as shown, for example, in FIGS. 19–21.

When a token 410 is inserted into keyway 437, bitted blade 446 positions tumbler pins 444 of mechanical portion 420 in a position which does not inhibit rotation of the key plug 430 relative to the core body 428. Bitted blade 446 also urges semi-spherical tumbler pin 445 upwardly storing energy in spring 475 that may be later released to urge storage end 486 of pivotally-mounted latch 481 upwardly and pivot blocker end 482 of latch 481 from its blocking position, in which it inhibits rotation of key plug 430 with respect to core body 428, to a second position (shown in phantom lines) in which blocker end 482 of latch 481 is no longer received in the blocker-receiving channel 471.

Blocker end 482 of latch 481 is pivoted out of the blocker-receiving channel 471 in response to removal of tip 497 of movable element 461 from indentation 491 in latch 481 after the electromagnet 465 has been momentarily energized in response to receiving an authorized code freeing the key plug 430 to rotate with respect to the core body 428.

Figure 22:
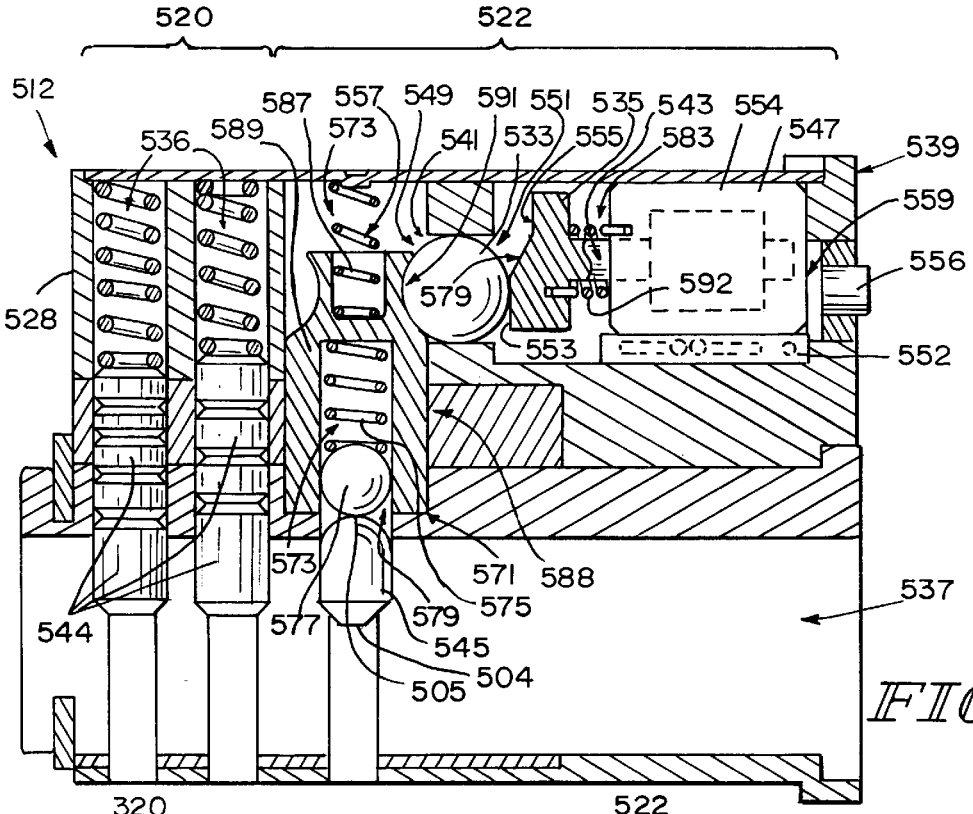
FIG. 22 is a sectional view of yet another preferred embodiment of the electronic lock core of the present invention showing a mechanical portion having two tumbler pin barrels each having tumbler pins partially extending into the keyway and blocking rotation of the key plug relative to the core body and a mechanical energy storage device including tumblers, a lower spring, a blocker body having an annular indentation and an upper spring, and a ball bearing received in a sleeve opening at one end adjacent to the blocker body and, at the other end, adjacent to a cam attached to a rotatable shaft, the ball bearing being received in the indentation to block motion of the blocker body.
Figure 23:
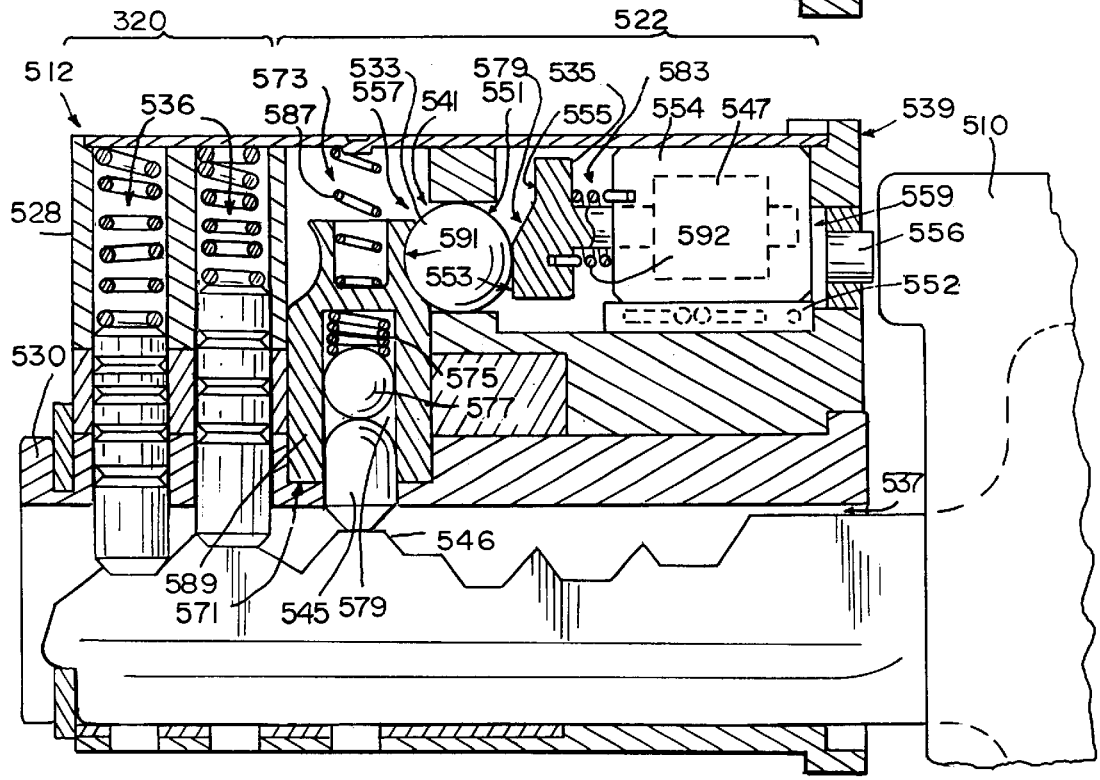
FIG. 23 is a cross-sectional view similar to FIG. 22 with a token of FIG. 8 received in the keyway aligning the tumbler pins of the mechanical portion to permit rotation of the key plug relative to the core body and compressing the lower spring of the mechanical energy storage device to store energy for moving the blocker body upward upon removal of the ball from the indentation of the blocker body.
Figure 24:
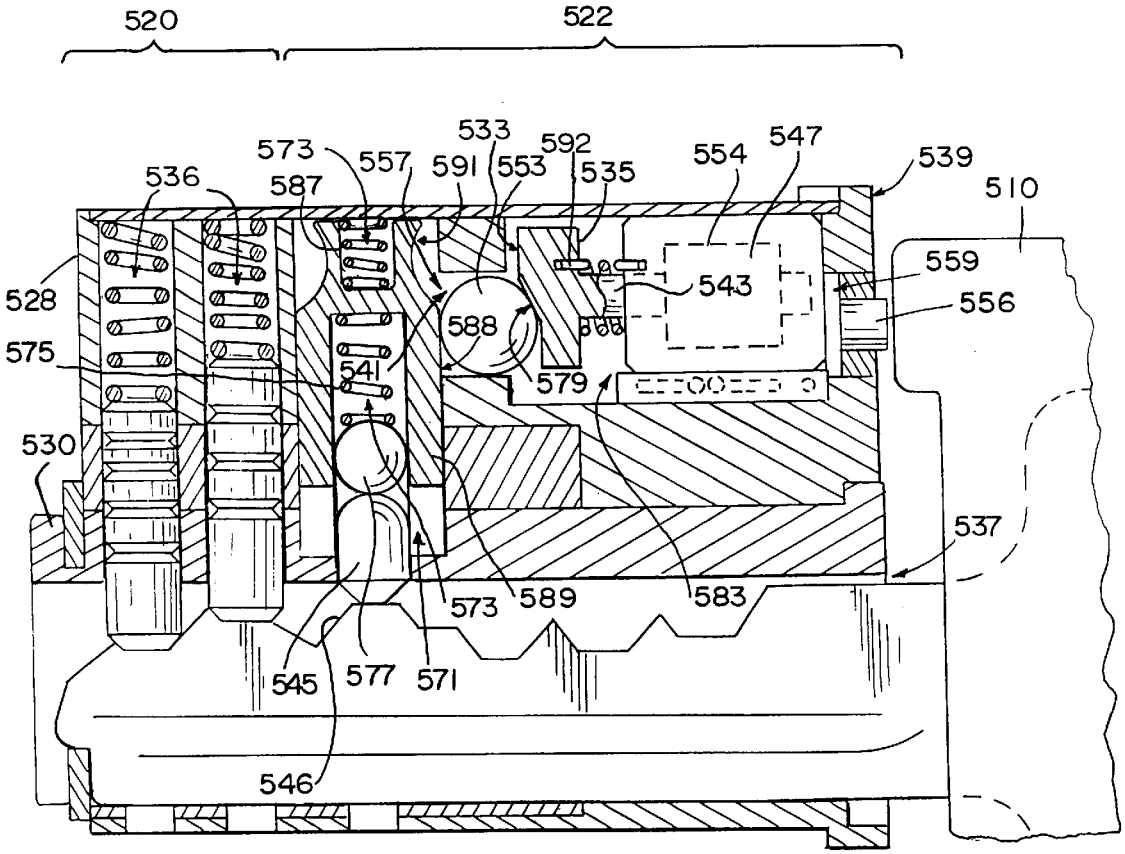
FIG. 24 is a cross-sectional view similar to FIG. 23 showing the cam rotated 180 degrees from the position shown in FIG. 23 by a rotatable solenoid in response to a valid access signal thereby allowing the ball to move out of the indentation of the blocker body which has been urged upward by the energy stored in the lower spring so that the blocker body no longer blocks rotation of the key plug relative to the core body.
Figures 25, 26, 27, 28:
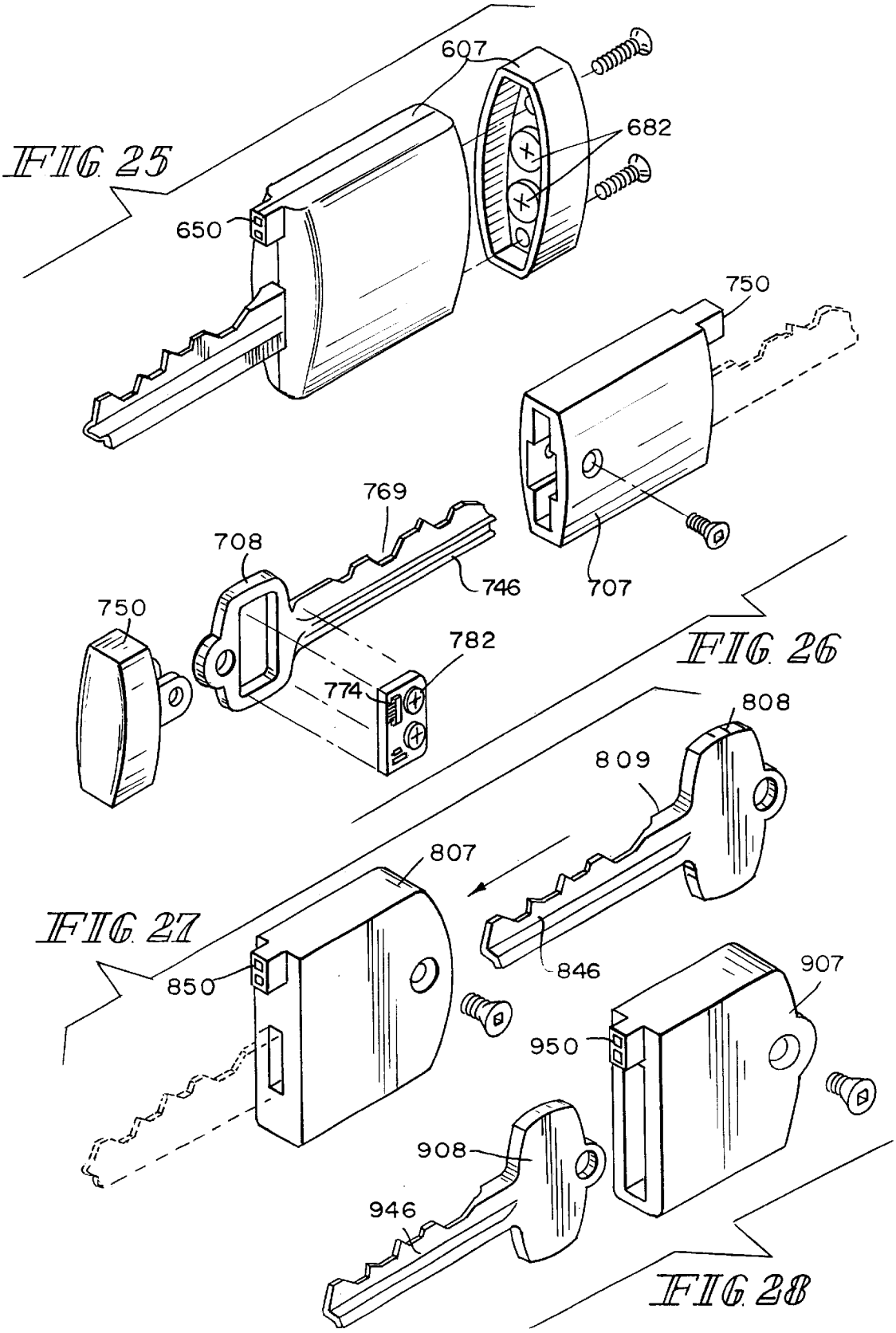
FIG. 25 is a partially exploded view of another preferred embodiment of a bow cover for a token.
FIG. 26 is a partially exploded view of yet another preferred embodiment of a bow cover.
FIG. 27 is a partially exploded view of yet another preferred embodiment of a bow cover.
FIG. 28 is a partially exploded view of yet another preferred embodiment of a bow cover.

Referring to FIGS. 22–24 a fifth embodiment of electronic lock core 512 is illustrated. Lock core 512 includes a mechanical portion 520, electrical portion 522, a key plug or lock actuator 530, and a core body 528. Mechanical portion 520 includes two tumbler pin barrels 536 each containing tumbler pins 544 partially extending into keyway 537 and blocking rotation of key plug 530 relative to core body 528. Electrical portion 522 includes a circuit 552, a electromagnetic actuator 554, a coupling or token communicator 556, and a mechanical linkage 557. As an alternative configuration to previously discussed embodiment of lock core 12, circuit 552 is located within cavity 583 instead of in cavity 559 in face plate 539. Mechanical linkage 557 includes a mechanical energy storage system 573, a ball bearing 533, a cam 535, and a ball bearing-receiving sleeve 541. Mechanical energy storage device 573 includes a semi-spherical ended tumbler 545, a spherical tumbler 577, a lower spring 575, an upper spring 587, and a blocker body 589 having an annular indentation 591. Cam 535 is attached to rotatable element 543 of a rotational solenoid 547. Ball bearing 533 is received in sleeve 541 which opens at one end 549 adjacent to blocker body 589 and at the other end 551 adjacent to a cam 535. Cam 535 has a first surface 553, a second surface 555, and an inclined surface 579 extending between the first and second surfaces 553, 555. Cam 535 is positioned so that when ball bearing 533 engages first surface 553 of cam 535, ball bearing 533 is held securely within indentation 591 in blocking body 589.

When a token 510 is initially inserted into keyway 537, bitted blade 546 aligns tumbler pins 544 of mechanical portion 520 to not inhibit rotation of key plug 530 relative to core body 528. Bitted blade 546 also engages and urges semi-spherical tumbler 545 upwardly compressing lower spring 575 of mechanical energy storage system 573. Compressed lower spring 575 stores energy for moving blocker body 589 upon removal of ball bearing 533 from indentation 591 of blocker body 589. However, until a valid authorization code is received and rotational solenoid 547 is energized, ball bearing 533 is securely held within indentation 591 preventing blocking body 589 from moving upwardly out of blocker-receiving cavity 571 formed in key plug 530. Therefore, electrical portion 522 continues to inhibit rotation of key plug 530 relative to core body 528.

If token 510 sends a valid access code to electronic core 512, rotational solenoid 547 rotates 180 degrees from the position shown in FIGS. 22–23 to the position shown in FIG. 24. During the rotation of rotatable shaft 543 of rotatable solenoid 547, ball bearing 533 is urged out of indentation 591 by upward motion of blocking body 589 so that ball bearing 533 rides along inclined surface 579 to second surface 555 of cam 535. Blocker body 589 is urged upwardly by the energy previously stored in lower spring 575. Upward movement of blocking body 589 causes blocking body 589 to not be received in blocker-receiving cavity 571 and therefore to not block rotation of the key plug 530 relative to the core body 528. Upward movement of blocker body 589 also compresses upper spring 587 to store energy to facilitate return of blocker body 589 to its blocking state upon removal of bitted blade 546 from keyway 537.

Once blocker body 589 has moved upwardly, ball bearing 533 engages sidewall 588 of blocker body 589 and is squeezed between second surface 555 and side wall 588 mechanically preventing cam 535 and movable element 543 of rotational solenoid 547 from returning to their initial orientations. Although rotatable element 543 is spring 592 biased to return to the position shown in FIGS. 22–23 when no current flows through solenoid 547, it is prevented from doing so by the above squeezing action. Thus, rotational solenoid 547 no longer needs to be energized to maintain it in the non-blocking position allowing power consumption of electrical portion 522 of lock core 512 to be reduced.

When bitted blade 546 is removed form keyway 537, upper spring 587 expands and urges blocking body 589 downwardly into blocker-receiving cavity 571. During this downward movement, ball bearing 533 follows side wall 588 of blocking body 589 until it is forced back into indentation 591 of blocking body 589. Thus no electrical power is consumed to restore lock core 512 to a state in which key plug 530 is prohibited from rotating relative to lock core 528.

As previously mentioned, the circuits 48, 52 and contacts or couplings 50, 56 used in each of the five specifically described embodiments may vary as to their configurations and individual components. Various examples of circuit 48, 52 configurations are illustrated and described in provisional application Serial No. 60/080974 that is expressly incorporated by reference. Contacts and couplings 50, 56 including metallic contacts, conductive elastic contacts, capacitive couplings, inductive couplings, optical couplings and combinations of the aforementioned are also illustrated and described in the provisional application. Additional examples of circuits 48, 52 and contacts or couplings 50, 56 are described and illustrated in U.S. Pat. Nos. 5,870,915, 5,870,913, 5,841,363, 5,836,187, 5,826,499, and 5,823,027, the disclosures of which are specifically incorporated herein by reference.

Although the invention has been described in detail with reference to certain preferred embodiments, variations and modifications exist within the scope and spirit of the invention as described and defined in the following claims.

What is claimed is:

1. An interchangeable lock core that is configured to communicate with a token having an access code, the interchangeable lock core comprising a core body, a lock actuator that is coupled to the core body for movement relative to the core body, the lock actuator having a passageway configured to receive at least a portion of the token, a token communicator coupled to the core body, a blocker movable between a first blocker position wherein the lock actuator is fixed to the core body and a second blocker position wherein the lock actuator is movable relative to the core body, at least one tumbler element movable between a first tumbler position and a second tumbler position, a spring positioned to lie between the at least one tumbler element and the blocker, and an electromagnetic actuator coupled to the core body and coupled to the token communicator, the electromagnetic actuator being movable between a locking position in which the blocker is locked in the first blocker position and a releasing position in which the blocker is movable from the first blocker position to the second blocker position, the spring being compressed between the at least one tumbler element and the blocker when the at least one tumbler element moves from the first tumbler position to the second tumbler position as a result of insertion of the token into the passageway, the electromagnetic actuator moving to the releasing position if the token communicator reads the access code, and the spring acting between the at least one tumbler element and the blocker to move the blocker from the first blocker position to the second blocker position after the electromagnetic actuator moves to the releasing position.

2. The lock core of claim 1, wherein the at least one tumbler element moves along an axis when moving between the first and second tumbler positions and the blocker moves along the axis when moving between the first and second blocker positions.

3. The lock core of claim 2, wherein the spring includes a coil spring that is coiled about the axis.

4. The lock core of claim 2, wherein the blocker is formed to include a bore and the spring is situated in the bore.

5. The lock core of claim 1, wherein the electromagnetic actuator includes a movable element that is spring biased into engagement with the blocker when the electromagnetic actuator is in the locking position.

6. An interchangeable lock core for use with a token having an access code, the lock core comprising a core body, a lock actuator coupled to the core body for movement relative to the core body, a token communicator coupled to the core body, and an electrical portion coupled to the core body, the electrical portion including a blocker movable along a first axis between a first blocker position wherein the blocker fixes the position of the lock actuator relative to the core body and a second blocker position wherein the blocker permits movement of the lock actuator relative to the core body, an electromagnet coupled to the token communicator, a biasing member that biases the blocker toward the second blocker position, a movable member coupled to the core body for rotation about a pivot axis, the movable member being movable by the electromagnet between a first position wherein the movable member contacts the blocker and a second position spaced apart from the first position, the biasing member being configured to move the blocker to the second blocker position when the movable member is in the second position, and the first axis being spaced apart from the pivot axis.

7. The lock core of claim 6, wherein the biasing member is a spring.

8. The lock core of claim 7, wherein the pivot axis is one of parallel with the first axis and perpendicular with the first axis.

9. The lock core of claim 6, further comprising a power supply configured to supply power to the electrical portion.

10. The lock core of claim 9, wherein the token communicator controls current supply to the electromagnet and the current supplied is supplied in a single pulse of short duration upon receipt of a valid access code.

11. The lock core of claim 6, further comprising a passageway formed in the lock actuator for receipt of a bitted blade of the token, a tumbler barrel partially formed in the core body and partially formed in the lock actuator, the tumbler barrel being in communication with the passageway and a plurality of tumbler pins contained in the tumbler barrel, the bitted blade engages a tumbler pin and positions the plurality of tumbler pins in the tumbler barrel to allow movement of the lock actuator with respect to the core body.

12. An interchangeable lock core for use with a token having an access code, the lock core comprising a core body, a lock actuator coupled to the core body for movement relative to the core body, a token communicator coupled to the core body, and an electrical portion coupled to the core body, the electrical portion including a blocker movable between a first position wherein the blocker fixes the position of the lock actuator relative to the core body and a second position wherein the blocker permits movement of the lock actuator relative to the core body, a biasing member that biases the blocker toward the second position, an electromagnet coupled to the token communicator, the electromagnet having spaced-apart first and second ends and a central portion between the first and second ends, the first end of the electromagnet having a cross sectional area, and a movable member movable by the electromagnet, the movable member having a surface facing the first end of the electromagnet and the surface having a cross-sectional area that is substantially equal to the cross sectional area of the first end of the electromagnet.

13. The lock core of claim 12, further comprising a passageway formed in the lock actuator for receipt of a bitted blade of the token, a tumbler barrel partially formed in the core body and partially formed in the lock actuator, the tumbler barrel being in communication with the passageway and a plurality of tumbler pins contained in the tumbler barrel, the bitted blade engages a tumbler pin and positions the plurality of tumbler pins in the tumbler barrel to allow movement of the lock actuator with respect to the core body.

14. The lock core of claim 12, further comprising a second biasing member biasing the movable member toward engagement with the blocker.

15. The lock core of claim 14, further comprising an indentation in the blocker within which a portion of the movable member is received when the blocker is in the first position.

16. The lock core of claim 15, wherein when the blocker is in the second position, the movable member engages a portion of the blocker spaced apart from the indentation.

17. An interchangeable lock core that is configured to communicate with a token having an access code and a blade, the interchangeable lock core comprising, a core body, a lock actuator that is coupled to the core body for movement relative to the core body and being formed to include a blade receiving passageway, a token communicator coupled to the core body, an electromagnet, a blocking member that is movable between a first position wherein the lock actuator is fixed to the core body and second position wherein the lock actuator is movable relative to the core body, a latch coupled to the electromagnet for movement relative to the electromagnet to couple and uncouple from the blocking member, and a first spring capable of biasing the blocking member toward the first position and a second spring capable of biasing the blocking member toward the second position, when the blade of the token is received in the passageway the second spring stores internal energy generated by insertion of the blade to bias the blocking member toward the second position regardless of the access code contained in the token.

18. The lock core of claim 17, wherein when the blade is received in the passageway, the electromagnet is energized if the token contains an authorized access code and the latch is decoupled from the blocking member which is urged to the second position by the energy stored in the second spring.

19. The lock core of claim 18, wherein the movement of the blocking member to the second position stores internal energy in the first spring.

20. The lock core of claim 17, further comprising a third spring biasing the latch toward engagement with the blocking member.

21. The lock core of claim 20, further comprising an indentation in the blocking member within which the latch is received when the blocking member is in the first position.

22. A lock core for use with a token including identification information and a bitted blade, the lock core comprising:

a core body having an aperture;

a lock actuator received in the aperture, the lock actuator being movable relative to the core body and including a passageway formed therein for receipt of the bitted blade of the token;

a first barrel partially formed in the core body and partially formed in the lock actuator in communication with the passageway;

a blade-engaging pin received in the first barrel, the blade-engaging pin having a first end extending into the passageway and a spaced apart second end;

at least one additional pin received in the first barrel and having a semi-spherical surface that engages the second end of the blade-engaging pin, the bitted blade engages the first end of the blade-engaging pin and positions the semi-spherical surface of the at least one additional pin so that movement of the lock actuator with respect to the core body is not inhibited;

a blocker movable relative to the core body between a first position in which the blocker prevents the lock actuator from moving relative to the core body and a second position in which the lock actuator is movable relative to the core body; and a spring situated in the first barrel, the spring engaging the blocker and engaging the at least one additional pin; further comprising an electromagnetic actuator having a locking position in which the blocker is prevented from moving out of the first position and a releasing position in which the blocker is movable from the first position to the second position.

23. The lock core of claim 22, wherein the bitted blade, when received in the passageway, moves the blade-engaging pin to a position in which the entire blade-engaging pin remains in the portion of the first barrel formed in the lock actuator.

24. The lock core of claim 22, wherein the blocker cooperates with the at least one additional pin to inhibit movement of the lock actuator relative to the core body when the bitted blade is removed from the passageway.

25. The lock core of claim 22, further comprising a second barrel partially formed in the core body and partially formed in the lock actuator in communication with the passageway and a plurality of tumbler pins contained in the second barrel and wherein the bitted blade engages one of the plurality of tumbler pins and positions the plurality of tumbler pins in the second barrel to allow movement of the lock actuator with respect to the lock core.

26. A lock core for use with a token including identification information and a bitted blade, the lock core comprising:

a core body having an aperture;

a lock actuator received in the aperture, the lock actuator being movable relative to the core body and including a passageway formed therein for receipt of the bitted blade of the token;

a barrel partially formed in the core body and partially formed in the lock actuator in communication with the passageway;

a blade-engaging pin received in the barrel having a first end extending into the passageway and a spaced apart second end;

at least one additional pin received in the barrel and having a semi-spherical surface that engages the second end of the blade-engaging pin, the bitted blade engages the first end of the blade-engaging pin and positions the semi-spherical surface of the at least one additional pin so that movement of the lock actuator with respect to the core body is not inhibited;

a blocker movable relative to the core body between a first position in which the blocker prevents the lock actuator from moving relative to the core body and a second position in which the lock actuator is movable relative to the core body;

a spring engaging the blocker and engaging the at least one additional pin; and an electromagnetic actuator having a locking position in which the blocker is prevented from moving out of the first position and a releasing position in which the blocker is movable from the first position to the second position, wherein movement of the blade-engaging pin and the at least one additional pin by the bitted blade compresses the spring and when the electromagnetic actuator moves to the releasing position, the spring expands to move the blocker from the first position to the second position.

27. The lock core of claim 26, further comprising a token communicator that is configured to read the identification information and to supply current to the electromagnetic actuator to move the electromagnetic actuator from the locking position to the releasing position after the identification information is read.

28. An interchangeable lock core that is configured to communicate with a token having an access code, the interchangeable lock core comprising:

a core body having an aperture having an axis;

a lock actuator received in the aperture and being movable relative to the core body;

a token communicator coupled to the core body;

a blocking member that is movable transverse to the axis between a first position wherein the lock actuator is fixed to the core body and second position wherein the lock actuator is movable relative to the core body;

an electromagnet;

a latch coupled to the electromagnet for movement transverse to the blocking member to couple and lock the blocking member in the first position and uncouple from and allowing the blocking member to assume the second position;

a first spring biasing the blocking member toward the first position; and a second spring biasing the latch toward coupling with the blocking member.

29. The lock core of claim 28, further comprising a power supply to energize the electromagnet.

30. The lock core of claim 29, wherein the power supply provides power to the electromagnet under the control of the token communicator.

31. The lock core of claim 29, wherein the token communicator controls supply of power from the power supply to the electromagnet as a single pulse of short duration upon receipt of a valid access code.

32. The lock core of claim 28, wherein the first and second springs are coil springs.

33. A lock core for use with a token having an access code and a blade, the lock core comprising a core body, a lock actuator coupled to the core body for movement relative to the core body, the lock actuator including a passageway in which the blade is inserted, a token communicator coupled to the core body, the token communicator being configured to read the access code when the blade is inserted into the passageway, at least one tumbler element movable between a first tumbler position in which the at least one tumbler element prevents the lock actuator from moving relative to the core body and a second tumbler position away from the first position, a blocker movable between a first blocker position wherein the blocker prevents the lock actuator from moving relative to the core body and a second blocker position away from the first blocker position, the lock actuator being unlocked for movement relative to the core body when the at least one tumbler element is in the second tumbler position and the blocker is in the second blocker position, a biasing member situated between the at least one tumbler element and the blocker, and an electromagnetic actuator coupled to the core body and coupled to the token communicator, the electromagnetic actuator being movable between a locking position in which the blocker is locked in the first blocker position and a releasing position in which the blocker is movable from the first blocker position to the second blocker position, the biasing member storing energy when the at least one tumbler element moves from the first tumbler position to the second tumbler position as a result of insertion of the blade into the passageway, the electromagnetic actuator moving to the releasing position if the token communicator reads the access code, and the biasing member releasing energy to move the blocker from the first blocker position to the second blocker position after the electromagnetic actuator moves to the releasing position.

34. The lock core of claim 33, wherein the blocker is formed to include a bore and the biasing member is positioned to lie in the bore.

35. The lock core of claim 34, wherein at least a portion of the at least one tumbler element is also positioned to lie in the bore.

36. The lock core of claim 35, wherein the bore defines an axis, the at least one tumbler element moves along the axis when moving between the first and second tumbler positions, and the blocker moves along the axis when moving between the first and second blocker positions.

37. The lock core of claim 33, wherein the blocker is formed to include a bore and at least a portion of the at least one tumbler element is received in the bore.

38. The lock core of claim 33, wherein the blocker is formed to include a groove, the electromagnetic actuator includes a movable element, at least a portion of the movable element is received in the groove when the electromagnetic actuator is in the locking position, and the movable element is withdrawn from the groove when the electromagnetic actuator moves from the locking position to the releasing position.

39. The lock core of clam 38, wherein the blocker moves along a first axis when moving between the first and second blocker positions, the movable element pivots about a second axis when the electromagnetic actuator moves between the locking and releasing positions, and the second axis is spaced apart from the first axis.

40. The lock core of claim 39, wherein the first axis is parallel with the second axis.

41. The lock core of claim 39, wherein the first axis is orthogonal to the second axis.

42. The lock core of claim 33, further comprising a second biasing member that acts between the core body and the blocker to bias the blocker toward the first position.

43. The lock core of claim 42, wherein the first biasing member is a coil spring and the second biasing member is a coil spring.

44. The lock core of claim 33, wherein the at least one tumbler element includes a spherical element and a non-spherical element.

45. The lock core of claim 33, wherein the at least one tumbler element moves along an axis during movement between the first and second tumbler positions and the blocker moves along the axis during movement between the first and second blocker positions.

46. The lock core of claim 33, wherein the blocker is coupled to the core body for pivoting movement.

47. The lock core of claim 46, further comprising a second biasing member that acts between the core body and the blocker to bias the blocker toward the first position.

48. The lock core of claim 47, wherein the second biasing member is a torsion spring.

49. The lock core of claim 47, wherein the second biasing member is a coil spring.

50. The lock core of claim 33, further comprising a mechanical linkage coupled to the electromagnetic actuator, the mechanical linkage including a rotatable cam and a ball, the blocker is formed to include an annular indentation, the ball being forced into the annular indentation by the cam when the electromagnetic actuator is in the locking position, and the ball being permitted to move out of the annular indentation when the electromagnetic actuator is in the releasing position.

51. The lock core of claim 50, wherein the blocker moves along a first axis when moving between the first and second blocker positions, the cam rotates about a second axis when the electromagnetic actuator moves between the locking and releasing positions, and the second axis is perpendicular to the first axis.

52. The lock core of claim 50, further comprising a torsion spring that biases the cam toward a position having the ball forced into the annular indentation.

* * * * *